US005294528A

United States Patent [19]

Furutachi

[11] Patent Number: 5,294,528

[45] Date of Patent: Mar. 15, 1994

[54] SILVER HALIDE PHOTOGRAPHIC MATERIAL CONTAINING A MAGENTA COUPLER AND A COMPOUND THAT CAN BREAK THE AGGREGATION OF AN AZOMETHINE DYE

[75] Inventor: Nobuo Furutachi, Minami-ashigara, Japan

[73] Assignee: Fuji Photo Film Co., Ltd., Kanagawa, Japan

[21] Appl. No.: 850,165

[22] Filed: Mar. 13, 1992

Related U.S. Application Data

[63] Continuation of Ser. No. 415,631, Oct. 2, 1989, abandoned.

[30] Foreign Application Priority Data

Oct. 7, 1988 [JP] Japan ..... 63-253480

[51] Int. Cl.[5] ..... G03C 7/38; G03C 1/34; G03C 1/38

[52] U.S. Cl. ..... 430/546; 430/551; 430/558; 430/631

[58] Field of Search ..... 430/558, 372, 551, 546, 430/631

[56] References Cited

U.S. PATENT DOCUMENTS

| | | | |
|---|---|---|---|
| 4,256,830 | 3/1981 | Jager et al. | 430/551 |
| 4,558,000 | 12/1985 | Yamagami et al. | 430/551 |
| 4,564,590 | 1/1986 | Sasaki et al. | 430/551 |
| 4,580,679 | 5/1986 | Furutachi et al. | 430/558 |
| 5,011,764 | 4/1991 | Sakai et al. | 430/546 |

FOREIGN PATENT DOCUMENTS

| | | | |
|---|---|---|---|
| 61-65245 | 4/1986 | Japan . | |
| 61-250644 | 11/1986 | Japan | 430/558 |
| 62-175754 | 8/1987 | Japan | 430/558 |
| 62-215273 | 9/1987 | Japan | 430/558 |
| 62-215954 | 9/1987 | Japan | 430/558 |
| 62-246052 | 10/1987 | Japan . | |
| 63-95439 | 4/1988 | Japan . | |
| 63-296044 | 12/1988 | Japan | 430/558 |

OTHER PUBLICATIONS

Chemistry, vol. 43, pp. 146–153 (1988).

J. Am. Chem. Soc., 1980, 102, pp. 7932–7934.

G. Koga et al., Dictionary of the Terms of Organic Chemistry, Sep. 20, 1990 (Asakura Shyoten), pp. 394–395.

*Primary Examiner*—Lee C. Wright

*Attorney, Agent, or Firm*—Birch, Stewart, Kolasch & Birch

[57] ABSTRACT

There is disclosed a silver halide color photographic material having at least one silver halide emulsion layer, wherein the silver halide emulsion layer comprises a magenta coupler and a compound that can break the aggregation of azomethine dye formed from said magenta coupler and the oxdized product of the color-developing agent. The silver halide color photographic material exhibits an excellent effect that the light-fastness of image dye and the color reproduction are good.

12 Claims, 1 Drawing Sheet

SILVER HALIDE PHOTOGRAPHIC MATERIAL CONTAINING A MAGENTA COUPLER AND A COMPOUND THAT CAN BREAK THE AGGREGATION OF AN AZOMETHINE DYE

This application is a continuation of application Ser. No. 07/415,631 filed on Oct. 2, 1989, now abandoned.

FIELD OF THE INVENTION

The present invention relates to a silver halide color photographic material, and more particularly, to a silver halide color photographic material improved in light-fastness of the magenta dye image.

BACKGROUND OF THE INVENTION 1H-pyrazolo[1,5-b][1,2,4]triazole coupler and 1H-pyrazolo[3,2-c][1,2,4]triazole coupler are excellent in spectral absorption characteristics compared with 5-pyrazolone couplers, and therefore are used in some color photographic materials. However, the light-fastness of the magenta dye image formed from these couplers is still not satisfactory when the coupler is used alone, and therefore further improvement thereof is desired.

Thus, attempts to enhance the light-fastness of image dyes by combining the above pyrazolotriazole couplers with various antioxidants have been proposed, for example, in U.S. Pat. No. 4,588,679 and JP-A ("JP-A" means unexamined published Japanese patent application) No. 262,159/1985. An attempt to improve the light-fastness of image dyes by combining the above pyrazolotriazole couplers with a metal complex has been made, as known from U.S. Pat. No. 4,590,153. Attempts to improve the light-fastness of image dyes by combining the above pyrazoloazole couplers with amine compounds, as described in JP-A Nos. 246052/1987 and 95,439/1988, have also been proposed.

On the other hand, various interesting behaviors have been found by the studies of dyes derived from the pyrazoloazole series coupler. That is, for example, these dyes are liable to aggregate and the dyes aggregated are more liable to be decomposed by the irradiation of light than those not aggregated. An invention to improve the light-fastness of image dye by changing the structure of coupler molecule has been made by utilizing this finding inversely. That is, JP-A No. 65,245/1986 discloses that the light-fastness of image dyes of couplers having an alkyl group directly connected through the secondary or the tertiary carbon atom to the skeleton of a pyrazoloazole coupler is remarkably improved.

Although these proposals much improve the light-fastness of image dyes, development of a further new technique for improving the light-fastness is greatly desired in color photography wherein image dyes are ideally required not to change permanently.

BRIEF SUMMARY OF THE INVENTION

The first object of the present invention is to provide a silver halide color photographic material that is remarkably improved with respect to image-dye fastness on exposure to light, and improved with respect to discoloration.

The second object of the present invention is to provide a silver halide color photographic material improved in light-fastness of the image dye, and in color reproduction.

The above and other objects, features, and advantages of the invention will become apparent in the following description taken in connection with the accompanying drawing.

DETAILED DESCRIPTION OF THE INVENTION

Figure 1:
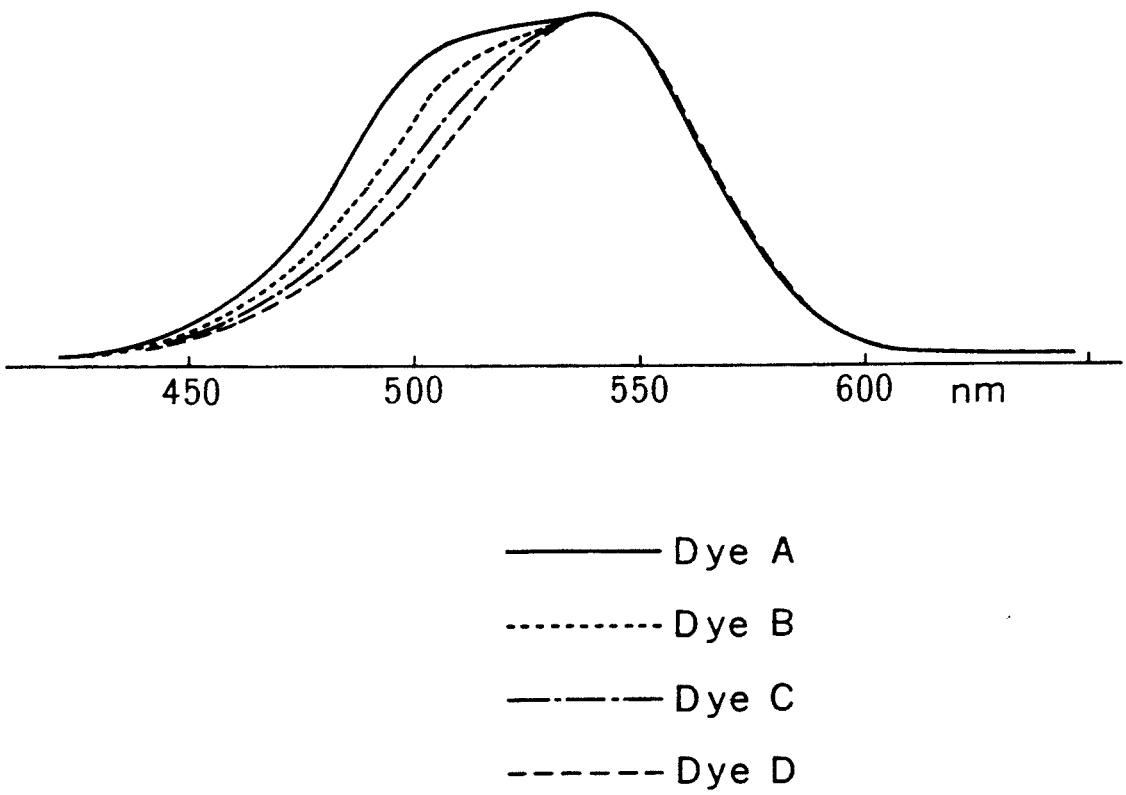
FIG. 1 is an absorption spectra in the visible region of 1H-pyrazolo[1,5-b][1,2,4]triazole dyes.

In order to attain the above objects, the inventors have made intensive investigations, and could have found the aggregation or association (hereinafter referred to as aggregation) property of dyes from the visible absorption spectra of dyes, to reach a discovery that azomethine dyes formed from pyrazoloazole couplers are liable to aggregate, and the higher the aggregation degree of the dyes is, the lower the light-fastness is, and that by breaking the aggregation the light-fastness of azomethine dyes can be enhanced. These findings are described in detail below as Reference Example. Studies of the findings have led to the discovery of the present invention.

That is, the objects of the present invention have been accomplished by a silver halide color photographic material having at least one silver halide emulsion layer on a base, wherein said emulsion layer comprises at least one magenta coupler represented by the following formula (I):

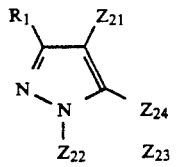

Formula (I)

wherein $R_1$ represents a hydrogen atom, or a substituent, $Z_{21}$ represents a hydrogen atom, or a group capable of being released upon coupling reaction with the oxidized product of an aromatic primary amine color developing agent, $Z_{22}$, $Z_{23}$, and $Z_{24}$ each represent

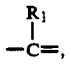

—N=, or —NH—, one of the $Z_{22}$–$Z_{23}$ bond and the $Z_{24}$–$Z_{22}$ bond is a double bond and the other is a single bond, and when the $Z_{23}$–$Z_{22}$ bond is a carbon-carbon double bond, it may be part of the aromatic ring, and at least one of the compounds that can break the aggregation of azomethine dye formed from said magenta coupler and the oxidized product of the color-developing agent.

The substituents of formula (I) will now be described in more detail.

$R_1$ represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group.

These substituents will now be further described in detail.

$R_1$ represents a hydrogen atom, a halogen atom (e.g., chlorine and bromine), an alkyl group (e.g., methyl, propyl, isopropyl, t-butyl, trifluoromethyl, tridecyl, 3-(2,4-di-t-amylphenoxy)propyl, ally, 2-dodecyloxyethyl, 3-phenoxypropyl, 2-hexylsulfonyl-ethyl, 3-(2-butoxy-5-t-hexylphenylsulfonyl)propyl, cyclopentyl, and benzyl), an aryl group (e.g., phenyl, 4-t-butylphenyl, 2,4-di-t-amylphenyl, and 4-tetradecaneamidophenyl), a heterocyclic group, (e.g., 2-furyl, 2-thienyl, 2-pyrimidinyl, and 2-benzothiazonyl), a cyano group, an alkoxy group (e.g., methoxy, ethoxy, 2-methoxyethoxy, 3-dodecyloxyethoxy, 2-phenoxyethoxy, and 2-methanesulfonylethoxy), an aryloxy group (e.g., phenoxy, 2-methylphenoxy, 2-methoxyphenoxy, and 4-t-butylphenoxy), a heterocyclic oxy group (e.g., 2-benzimidazolyloxy), an acyloxy group (e.g., acetoxy and hexadecanoyloxy), a carbamoyloxy group (e.g., N-phenylcarbamoyloxy and N-ethylcarbamoyloxy), a silyloxy group (e.g., trimethylsilyloxy), a sulfonyloxy group (e.g., dodecylsulfonyloxy), an acylamino group (e.g., acetoamido, benzamido, tetradecaneamido, α-(2,4-d-t-amylphenoxy)butyramido, γ-(3-t-butyl-4-hydroxyphenoxy)butyramido, and α-{4-(4-hydroxyphenylsulfonyl)phenoxy}decaneamido), an anilino group (e.g., phenylamino, 2-chloroanilino, 2-chloro-5-tetradecaneamidoanilino, 2-chloro-5-dodecyloxycarbonylanilino, N-acetylanilino, and 2-chloro- 5-{α-(3-t-butyl-4-hydroxyphenoxy)dodecaneamido}anilino), a ureido group, (e.g., phenylureido, methylureido, and N,N-dibutylureido), an imido group (e.g., N-succinimido, 3-benzylhydantoinyl, and 4-(2-ethylxanoylamino)phthalimido), a sulfamoylamino group (e.g., N,N-dipropylsulfamoylamino and N-methyl-N-decylsulfamoylamino), an alkylthio group (e.g., methylthio, octylthio, tetradecylthio, 2-phenoxyethylthio, and 3-phenoxypropylthio), 3-(4-t-butylphenoxy)propylthio), an arylthio group (e.g., phenylthio, 2-butoxy-5-t-octylphenylthio, 3-pentadecylphenylthio, 2-carboxyphenylthio, and 4-tetradecaneamidophenylthio), a heterocyclic thio group (e.g., 2-benzothiazolylthio), an alkoxycarbonylamino group (e.g., methoxycarbonylamino and tetradecyloxycarbonylamino), an aryloxycarbonylamino group (e.g., phenoxycarbonylamino and 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, and 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, and N-{3-(2,4-di-tert-amylphenoxy)propyl}carbamoyl), an acyl group (e.g., acetyl and (2,4-di-tert-amylphenoxy)acetylbenzoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, toluenesulfonyl, and 2-butoxy-5-tert-octylphenylsulfonyl), a sulfinyl group (e.g., octanesulfinyl, dodecylsulfinyl, and phenylsulfinyl), an alkoxycarbonyl group (e.g., methoxycarbonyl, butyloxycarbonyl, dodecylcarbonyl, and octadecylcarbonyl), or an aryloxycarbonyl group (e.g., phenyloxycarbonyl and 3-pentadecyloxycarbonyl).

In formula (I), $Z_{21}$ represents a hydrogen atom, or a group capable of being released upon a coupling reaction with the oxidized product of an aromatic primary amine color developing agent. More particularly, the group capable of being released upon the coupling reaction includes, for example, halogen atoms (e.g. fluorine, chlorine, and bromine), alkoxy groups (e.g., dodecyloxy, dodecyloxycarbonylmethoxy, methoxycarbamoylmethoxy, carboxypropyloxy, and methanesulfonyloxy), aryloxy groups (e.g., 4-methylphenoxy, 4-tert-butylphenoxy, 4-methoxyphenoxy, 4-methanesulfonylphenoxy, and 4-(4-benzyloxyphenylsulfonyl)-phenoxy), acyloxy groups (e.g., acetoxy, tetradecanoyloxy, and benzoyloxy), sulfonyloxy groups (e.g., methanesulfonyloxy, and toluenesulfonyloxy), amido groups (e.g., dichloroacetylamino, methanesulfonylamino, and trifonylphosphonamido), alkoxycarbonyloxy groups (e.g., ethoxycarbonyloxy, and benzyloxycarbonyloxy), aryloxycarbonyloxy groups (e.g., phenoxycarbonyloxy), aliphatic or aromatic thio groups (e.g., phenylthio, dodecylthio, benzylthio, 2-butoxy-5-tert-octylphenylthio, (2-pivaloylamidophenylthio, 2,5-dioctyloxyphenylthio, 2-(2-ethoxyethoxy)-5-tert-octylphenylthio, and tetrazolylthio), imido groups (e.g., succinimido, hydantoinyl, 2,4-dioxooxazolidin-3-yl, and 3-benzyl-4-ethoxyhydantoin-1-yl), N-heterocyclic rings (e.g., 1-pyrazolyl, 1-benzotriazolyl, and 5-chloro-1,2,4-triazol-1-yl), and aromatic azo groups (e.g., phenylazo). These groups capable of being released upon the coupling may contain a photographically useful group.

A dimer or higher polymer may be formed through $R_1$ or $Z_{21}$ of formula (I).

Of the compounds represented by formula (I), particularly preferable compounds are represented by formula (II) or (III):

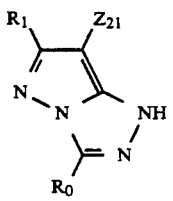

Formula (II)

-continued

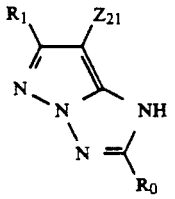

Formula (III)

wherein $R^1$ has the same meaning as defined for formula (I), $R_0$ has the same meaning as $R_1$, and $R_1$ and $R_0$ may be the same or different, provided that when $R_1$ is a hydrogen atom, a halogen atom, or a cyano group, $R_0$ is not a hydrogen atom, a halogen atom, or a cyano group.

Of formulae (II) and (III), formula (III) is particularly preferable.

Compounds used as magenta coupler in the present invention are shown below, but the present invention is not limited to them.

(M-1)

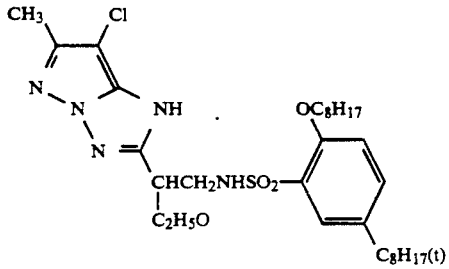

(M-2)

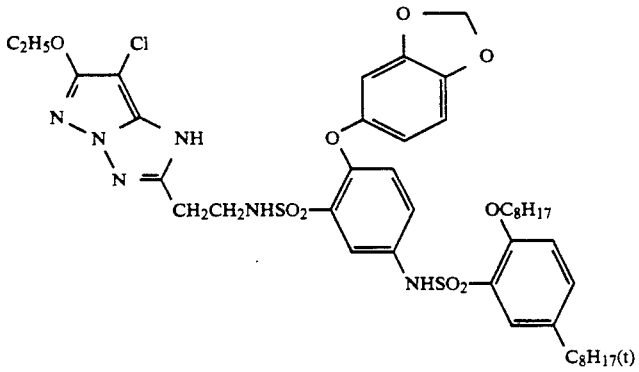

(M-3)

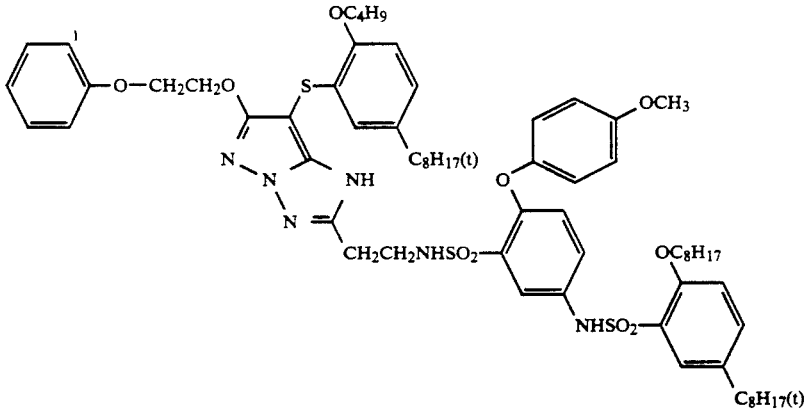

(M-4)

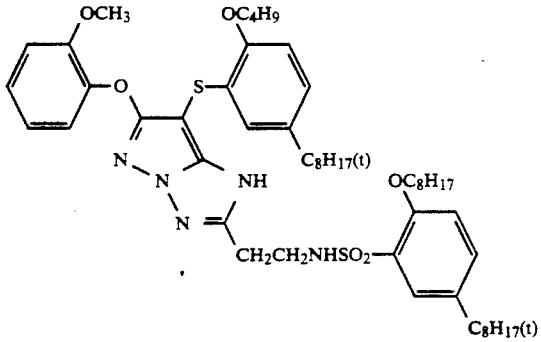

-continued
(M-5)
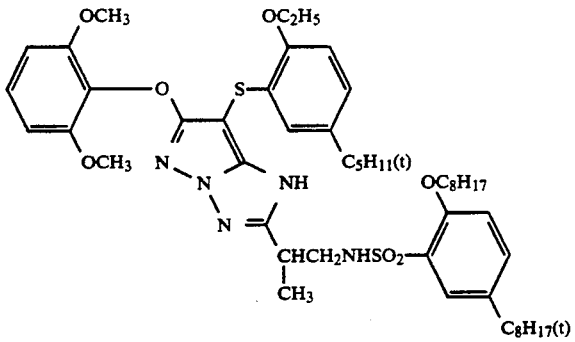
(M-6)
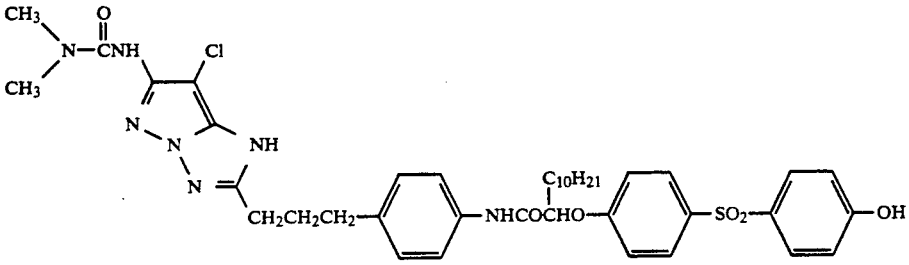
(M-7)
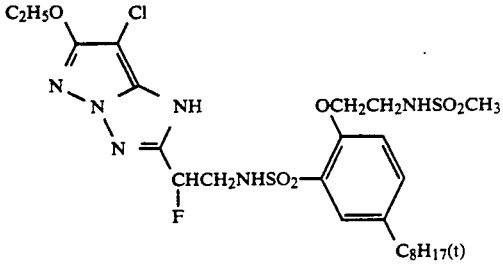
(M-8)
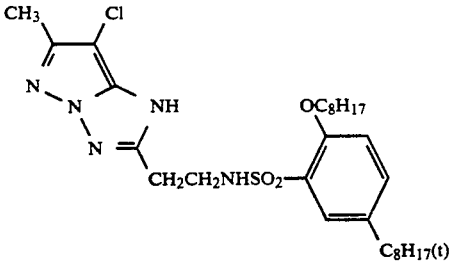
(M-9)
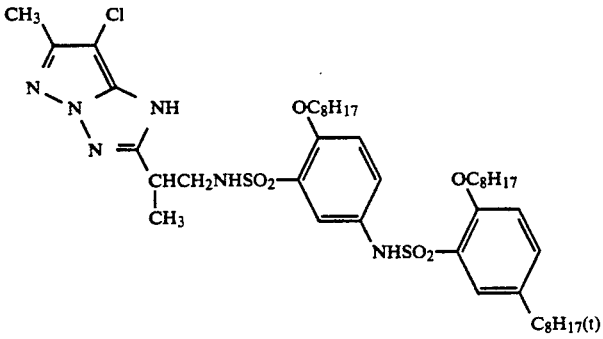

-continued
(M-10)
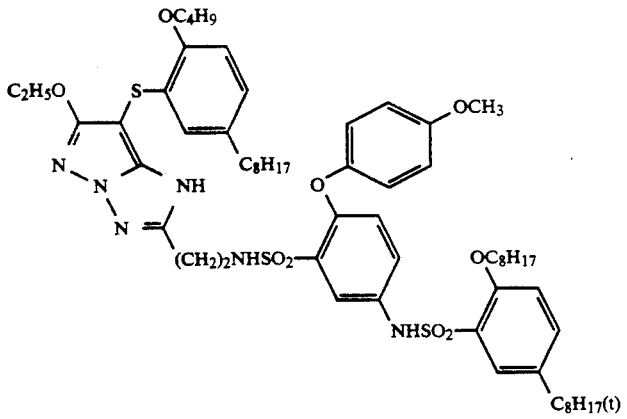
(M-11)
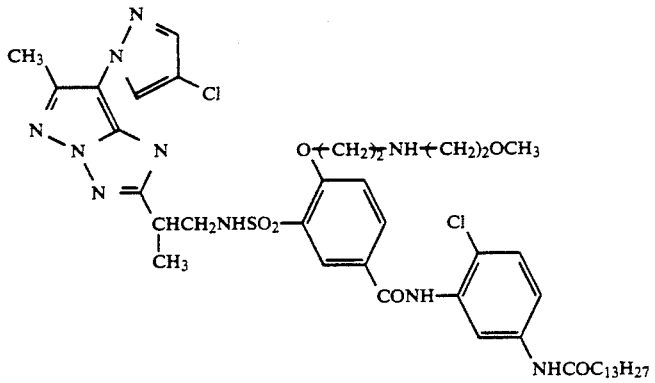
(M-12)
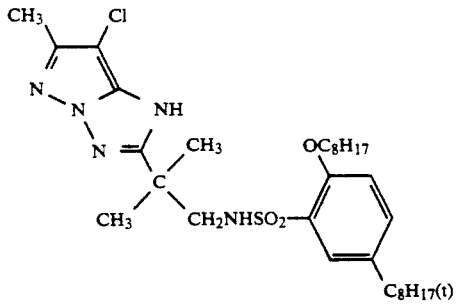
(M-13)
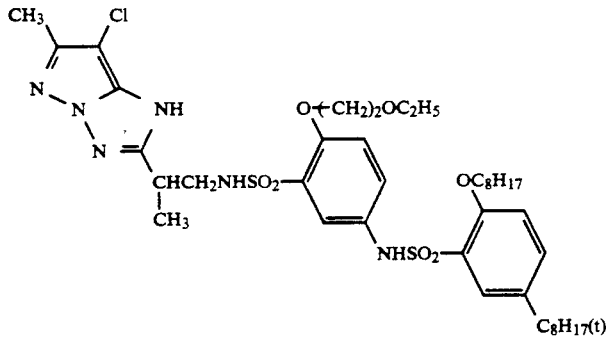

-continued
(M-14)
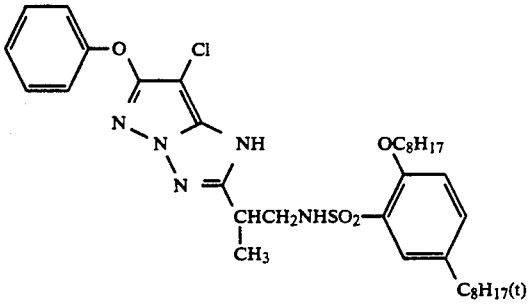
(M-15)
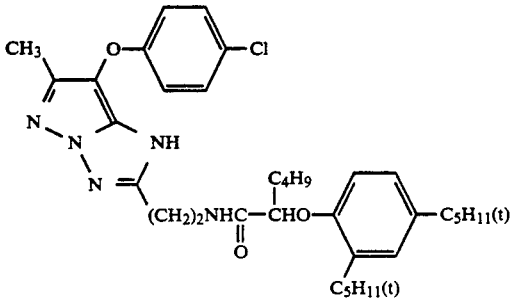
(M-16)
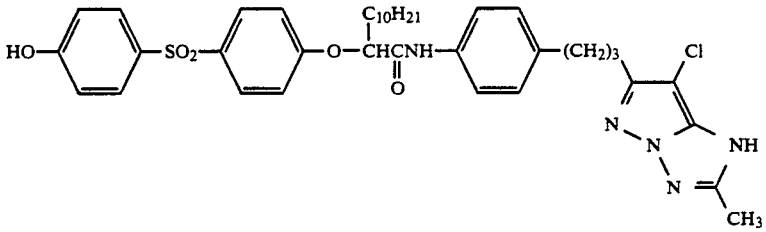
(M-17)
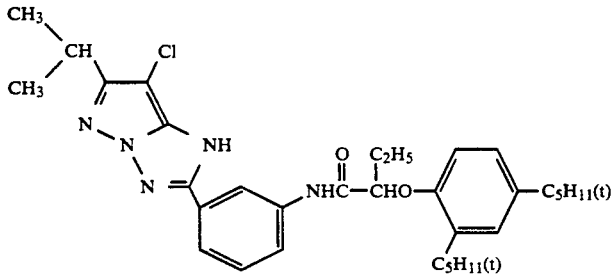
(M-18)
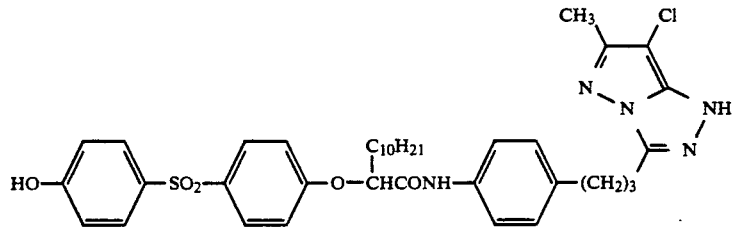
(M-19)
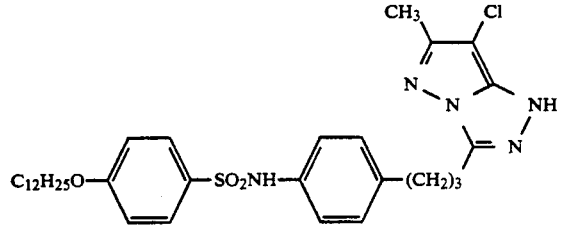

-continued
(M-20)
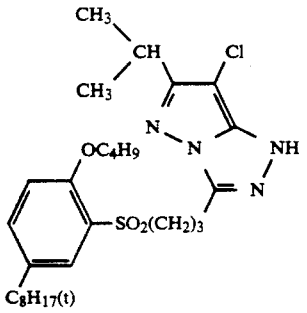
(M-21)
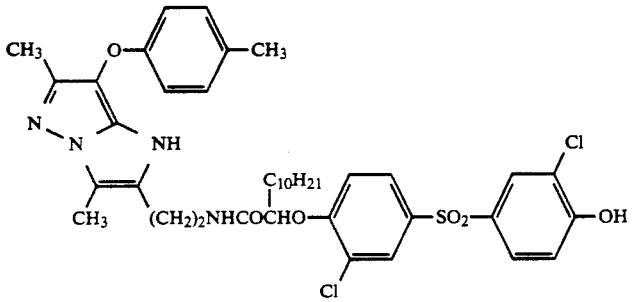
(M-22)
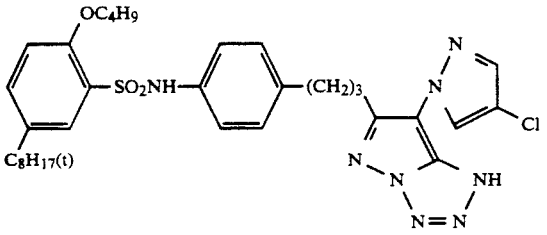
(M-23)
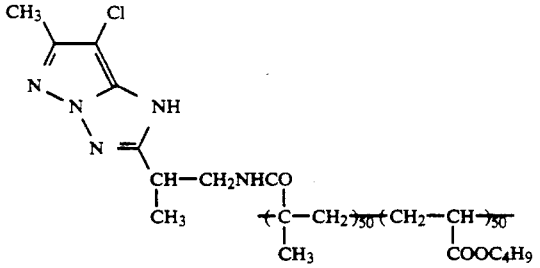
(M-24)
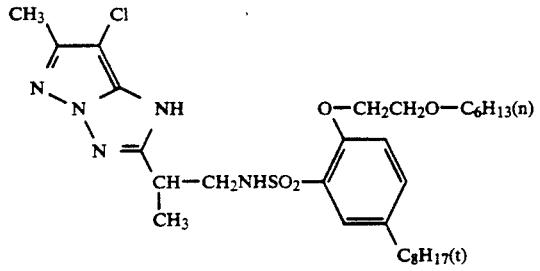

-continued
(M-25)
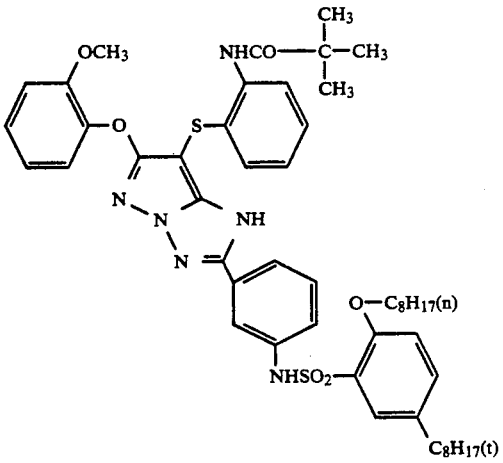
(M-26)
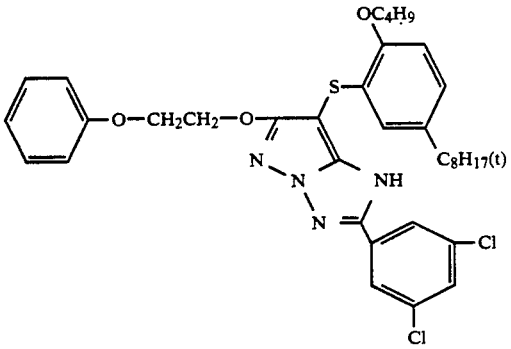
(M-27)
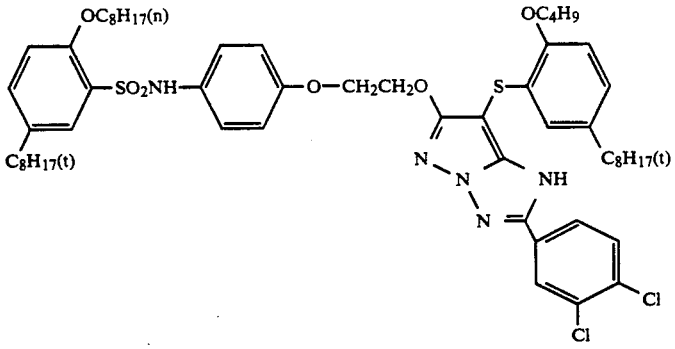
(M-28)
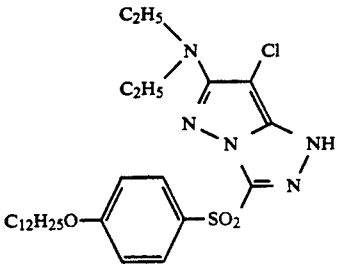

-continued (M-29)

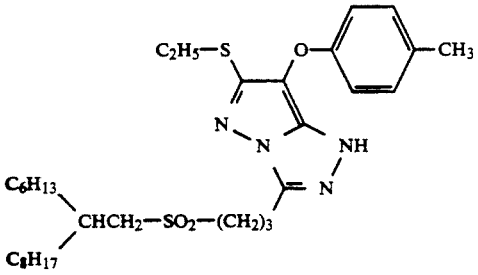

These couplers can be synthesized by methods described, for example, in U.S. Pat. Nos. 3,725,067, 4,540,654, and 4,500,630, JP-A No. 33,552/1985, International Patent (WO) 86-01915, and JP-A Nos. 197,688/1985 and 221,671/1986.

Usually the color couplers are used in an amount of 0.001 to 1 mol per mol of photosensitive silver halide. Preferred amounts of couplers are 0.01 to 0.5 mol for yellow coupler, 0.003 to 0.5 mol for magenta coupler, and 0.02 to 0.3 mol for cyan coupler, per mol of photosensitive silver halide, respectively.

The compound that can break the aggregation of the azomethine dyes formed from the magenta dyes of formula (I) will now be described.

It is supposed that the stabilization of aggregated dyes is caused by a force such as a hydrogen bond between monomeric molecules, a van der Waals force, a hydrophobic bonding, a stacking force due to piling up of aromatic rings, and a micell formation by an amphipatic compound. Therefore, reversely, in order to disaggregate the aggregated dyes to a monomeric form, it will be necessary to destroy such stabilizing forces for aggregation. Consequently, it is considered to use such a group of compounds that can recognize a dye molecule and isolate it from others, that can move between dye molecules to convert them to a monomeric form, and that can destroy the hydrogen bond between dye molecules by a stronger hydrogen bonding force.

The compound used in the present invention that can break aggregation may be any compound that has the property of substantially dissociating the associated or aggregated molecules of pyrazoloazolazomethine dyes into monomeric species. Of them, particularly preferable compounds are the following groups of compounds:

(A) Host compounds related to acetylenealcohols or other alcohols.
(B) Large hetero-ring host compounds and large carbon-ring host compounds, such as crown ethers.
(C) Host compounds related to cyclodextrin inclusion compounds.
(D) Amphipatic compounds that form LB films.
(E) Aromatic spiro-compounds and BINAP-series compounds.
(F) Hydrogen-bond-breaking agents.
(G) Compounds that can break aggregation of photographic sensitizing dyes.
(H) 2-(2-hydroxyphenyl)benzotriazole compounds.

Now these compounds will be described in detail.

(A) Host compounds related to acetylene-alcohols or other alcohols

These compounds are compounds developed by Fumio Toda (a professor of the faculty of technology, University of Ehime) et al., which can form 1:1 or 1:2 complexes and are described, for example, in *Chemistry and Industry* #4, P279 (1985); *Tetrahedron Letters* No. 33, 3695 (1986); ibid., Vol. 22, No. 39, 3865 (1981); *Nihonkacaku-kaishi* 1983, (2), pp. 239 to 242; *Chemistry Letters*, pp. 1521 to 1524 (1983); *J. Amer. Chem. Soc.*, 1983 105 pp. 5151 to 5152; and *Chemistry Letters*, pp. 195 to 198 (1985). Typical compounds thereof are given below, but the present invention is not limited to them. Of these compounds, diacetylene-diols are preferable.

(A-1)

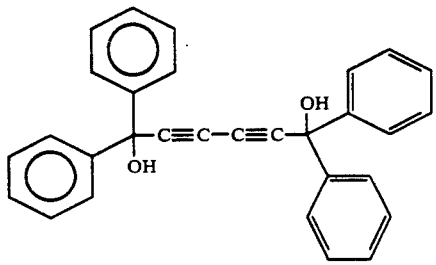

(A-2)

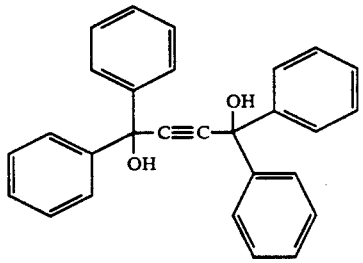

(A-3)

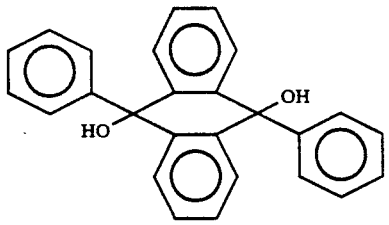

(A-4)

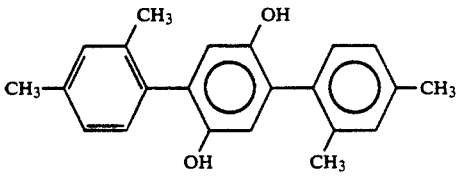

-continued (A-5)

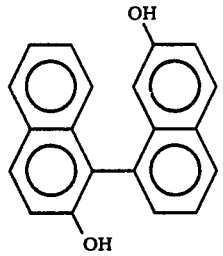

(A-6)

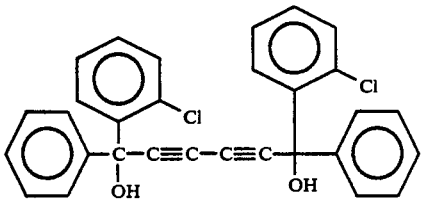

(A-7)

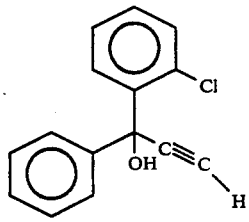

(A-8)

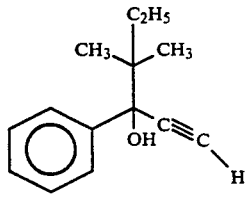

(A-9)

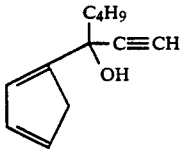

(A-10)

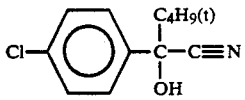

(A-11)

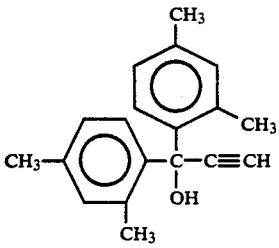

(A-12)

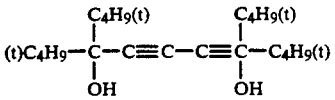

-continued (A-15)

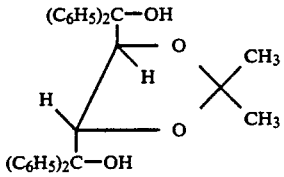

(B) Large hetero-ring host compounds and large carbon-ring host compounds:

As this series of compounds, synthetic large ring polyethers (crown ethers) were synthesized by Pedersen (a 1987 Nobel Prize in chemistry recipient), and since he reported their unique properties, as many as tens of thousands or more such compounds have been reported up to now. These compounds are described in detail, for example, by G. W. Gokel and S. H. Korzeniowshi in *Macrocyclic Polyether Syntheses,* Springer-Verlag (1982), by Michio Hiraoka in *Crown Compounds,* Kodansha (1978), by a joint work of Hiraoka, Yanagida, Ohara, and Koga in *Chemistry in Host and Guest,* Kodansha Scientific (1984), and by Sasaki and Koga in *Organic Synthetic Chemistry,* Vol. 45 (#6), pp. 571 to 582 (1987), and are reported in series of books, introductions, etc.

Large hetero-ring host compounds and large carbon-ring host compounds used in the present invention are preferably ones having a ballasting group, since they are contained in a photographic film and prevent or break aggregation of dyes. Of these compounds crown ethers are preferable.

Specific examples of the large hetero-ring host compounds and large carbon-ring host compounds used in the present invention are given below, but the present invention is not limited to them.

(B-1)

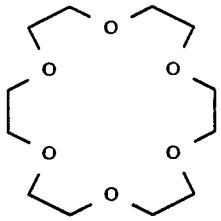

(B-2)

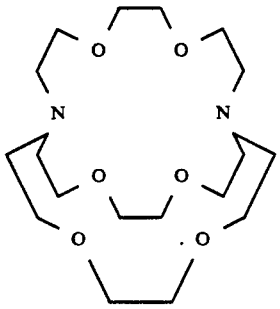

-continued
(B-3)
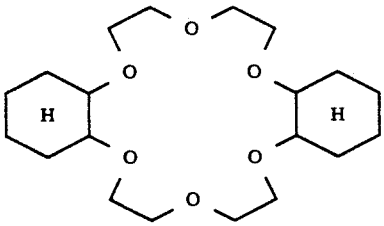
(B-4)
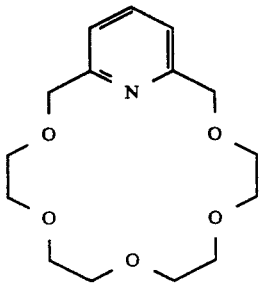
(B-5)
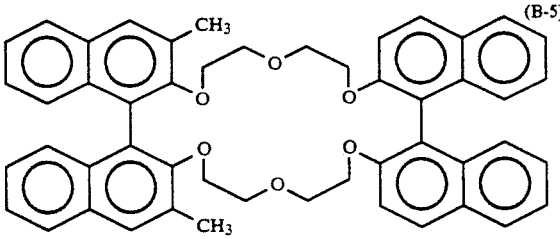
(B-6)
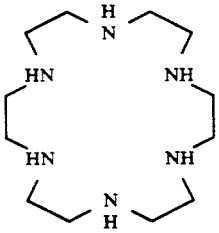
(B-7)
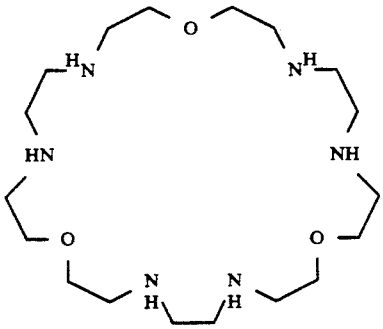
-continued
(B-8)
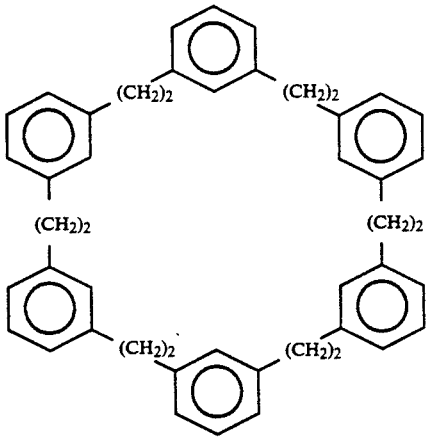
(B-9)
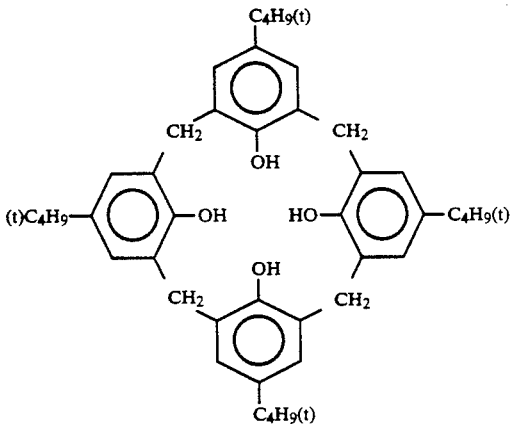
(B-10)
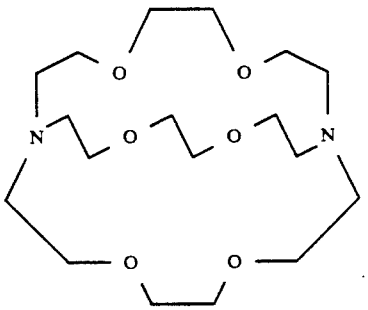
(B-11)
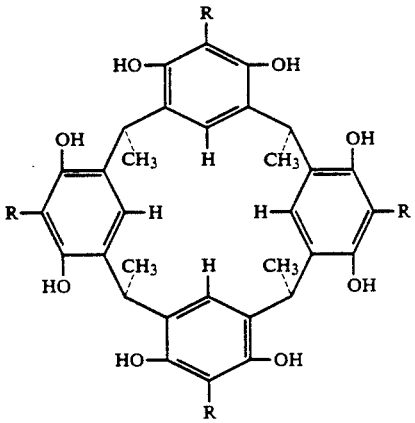

-continued (B-12)

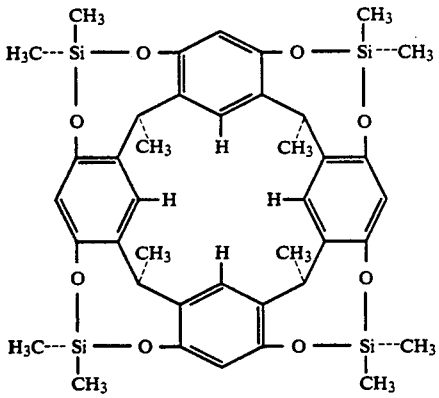

(B-13)

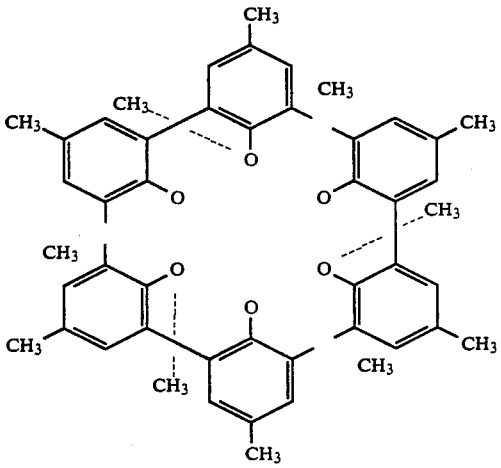

(B-14)

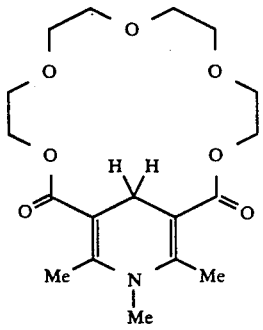

(B-15)

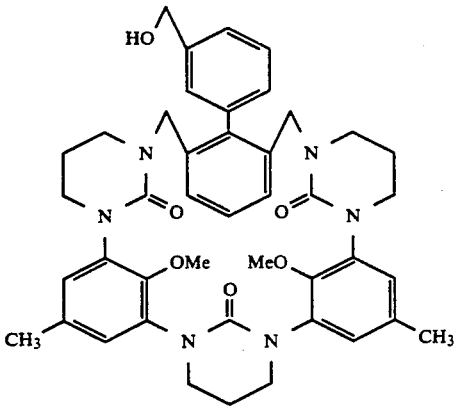

-continued (B-16)

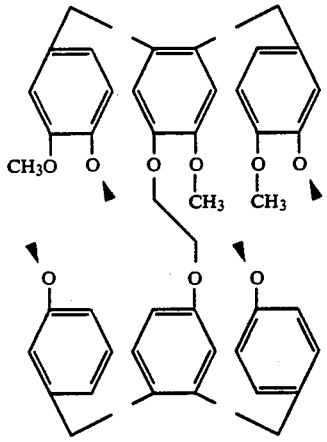

(C) Compounds related to cyclodextrin inclusion compounds

Since Cramer et al. of Max Plank Inst. reported in 1967 that cyclodextrins had functions similar to those of enzymes, studies investigating properties of cyclodextrins (α-, β-, and γ-compounds) that selectively include organic compounds have progressed. Cyclodextrin compounds are described in detail, for example, by M. Bender and M. Komiyama in *Chemistry of Cyclodextrin,* Gakkai-shuppan Center; by W. Saenger, Angrew Chem. Int. Ed. Engl., 19 344 (1980); and by I. Tabushi, *Acc. Chem. Res.,* 15, 66 (1982).

Cyclodextrins and their modified compounds that will be used in the present invention may be any of the compounds known from the literature and ballasted for photography.

Specific examples of typical cyclodextrin compounds are given below, but the present invention is not limited to them.

(C-1)

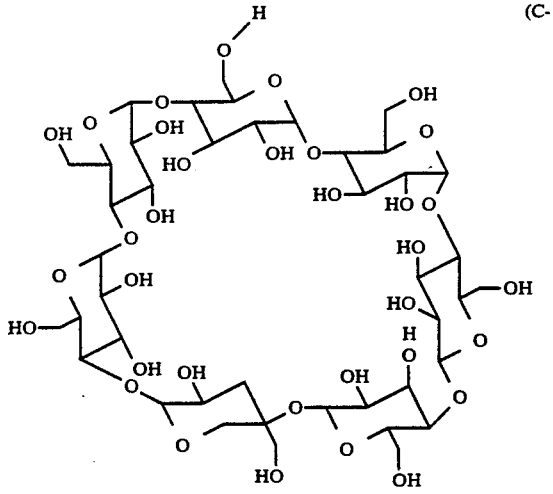

β-Cyclodextrin (hereinafter abbreviated as / \ )

-continued (C-2)

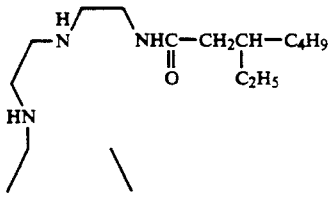

(C-3)

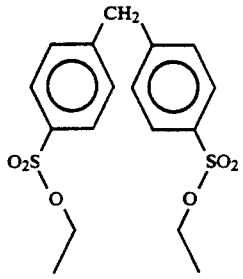

(C-4)

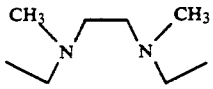

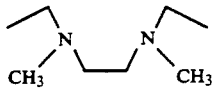

(C-5)

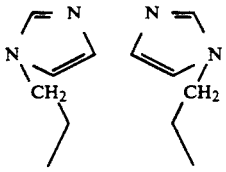

(C-6)

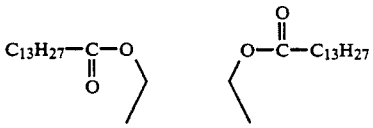

-continued (C-7)

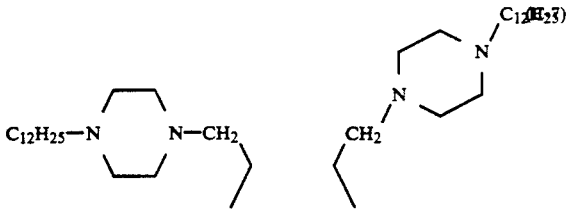

(C-8)

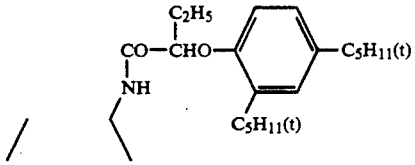

(D) Amphipatic compounds that form Langmuir-Blodgett films

These compounds are natural amphipatic compounds that form bimolecular films (biomembranes) in living organisms, and artificial amphipatic compounds, whose field is now under full investigation. These compounds include those described, for example, by a joint work of J. B. Finean, R. Coleman, and R. H. Michell (translated jointly by Sato and Hino), *Membranes and their cellular Functions, 3rd. Ed.* Baifukan (1977), and by Murakami, Kikuchi, and Nakano in *Organic Synthetic Chemistry*, Vol. 45 (#7), pp. 640 to 653 (1987).

In order to weaken or break the aggregation or association of dyes in the present invention, these amphipatic compounds can be used as they are, or after the chemical structure thereof is modified a little so that they can be dissolved in the high-boiling organic solvents used in a photographic system.

Compounds used in the present invention are given below, but the present invention is not limited to them.

(D-1)

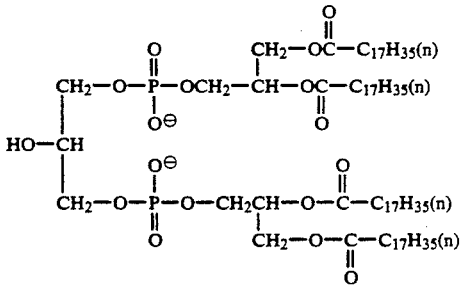

(D-2)

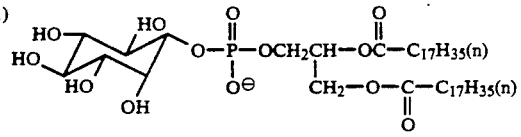

(D-3)

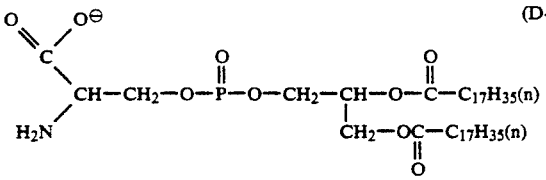

(D-4)

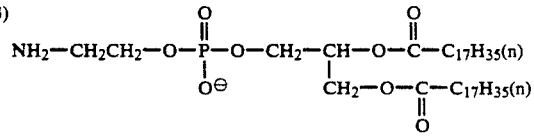

-continued (D-5)

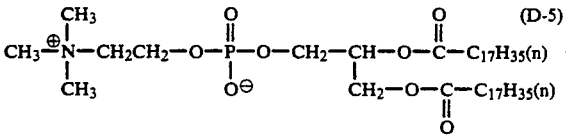

(D-6)

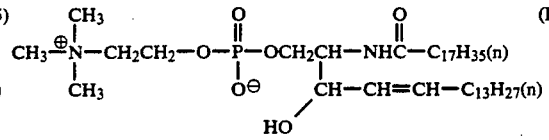

(D-7)

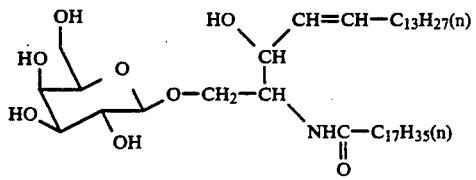

(D-8)

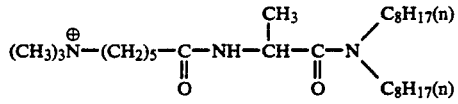

(D-9)

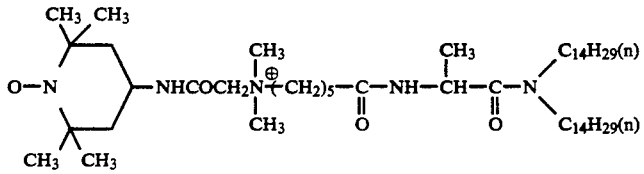

(D-10)

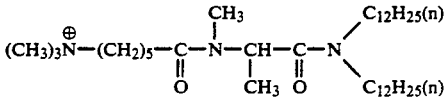

(D-11)

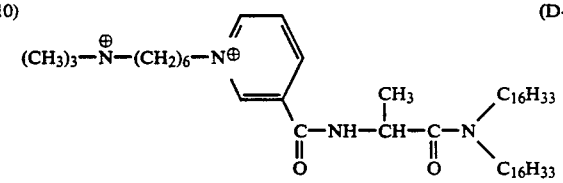

(D-12)

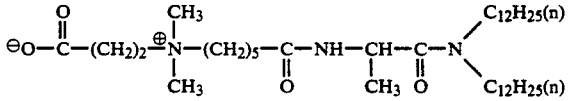

(D-13)

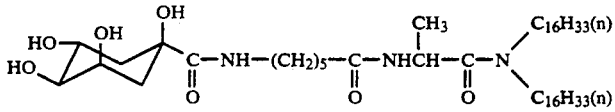

(E) Aromatic spiro-compounds and BINAP-series compounds:

Many aromatic spiro-compounds and compounds wherein a sterically voluminous substituent is included to make high the rotation barrier of the carbon-carbon bond, thereby allowing molecular dissymmetry to develop, are known.

When a pyrazoloazole dye molecule is suitably positioned in the spiro compound, or is positioned suitably with an axial bidentate ligand, typically BINAP, the aggregation of dye molecules can be broken up.

BINAP-series compounds developed by Ryoji Noyori and Hidemasa Takaya are described in detail in *Chemistry*, Vol. 43, pp. 146 to 153 (1988). These compounds are given below, but the present invention is not limited to them.

(E-1)

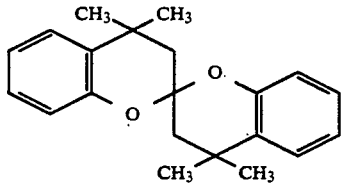

(E-2)

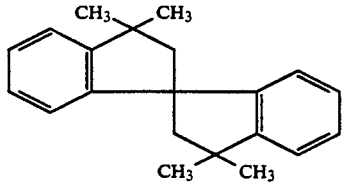

-continued
(E-3)
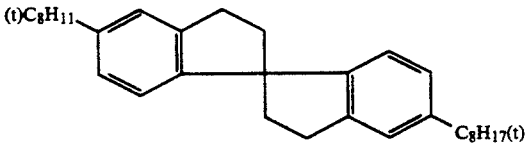
(E-4)
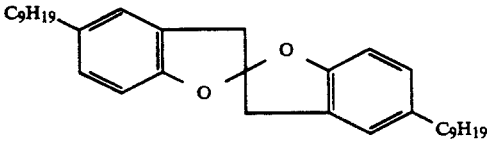
(E-5)
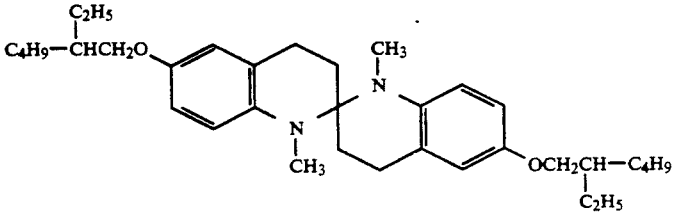
(E-6)
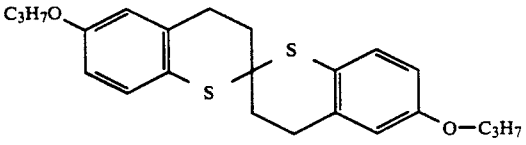
(E-7)
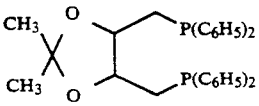
(E-8)
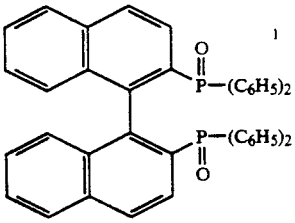
(E-9)
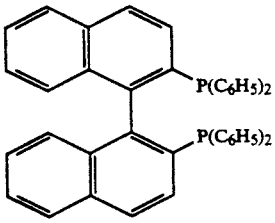
(E-10)
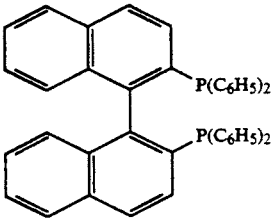
(S)-BINAP -continued (E-11)

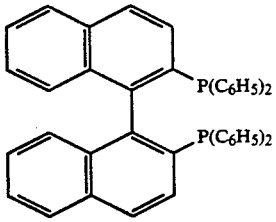

(R)-BINAP (E-12)

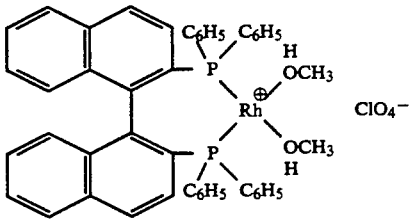

(E-13)

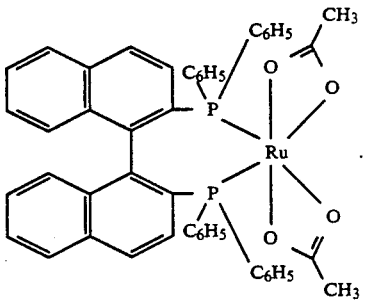

(F) Hydrogen-bond-breaking agents

Aggregation of dyes often is caused by hydrogen bonds between the molecules, and compounds that can break up the hydrogen bonds are effective in disbanding the aggregation of dyes. As a compound that can break up the hydrogen bonds between molecules, urea in aqueous solution is famous. Oil-soluble hydrogen-bond-breaking agents may be any of such substituted urea-compounds, and, for example, compounds described in JP-A No. 204041/1984 are known.

Preferable compounds are those represented by the following formula:

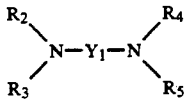

wherein $R_2$ and $R_4$ each represent a hydrogen atom or an alkyl group, $R_3$ and $R_5$ each represent a hydrogen atom, an alkyl group, an allyl group, a heterocyclic group, an acyl group, or a sulfonyl group, at least one of $R_2$, $R_3$, $R_4$, and $R_5$ represents a hydrogen atom, $R_2$, $R_3$, $R_4$, and $R_5$ are not hydrogen atoms at the same time, $R_2$ and $R_3$, $R_4$ and $R_5$, or $R_3$ and $R_5$ may together form a ring, and $Y_1$ represents a carbonyl group or a sulfonyl group. Structures of these oil-soluble hydrogen-bond-breaking agents are shown below, but the present invention is not limited to them.

(F-1)

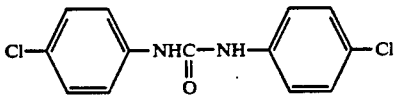

(F-2)

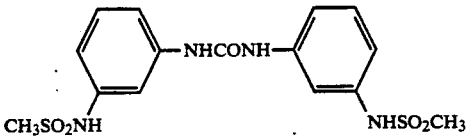

(F-3)

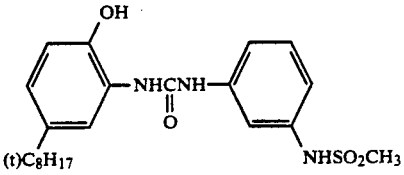

(F-4)

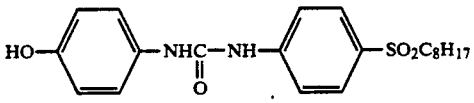

-continued
(F-5)
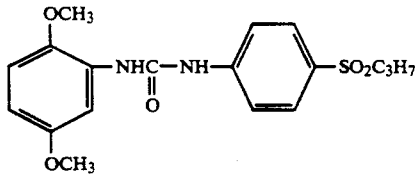
(F-6)
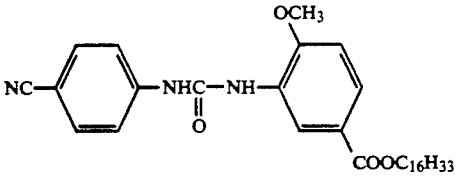
(F-7)
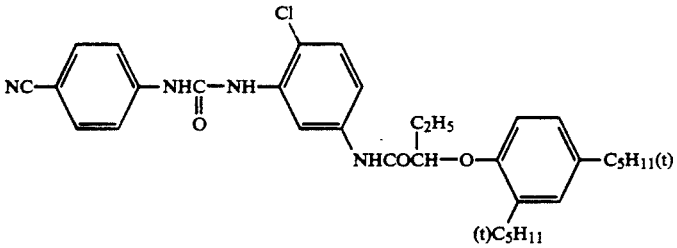
(F-8)
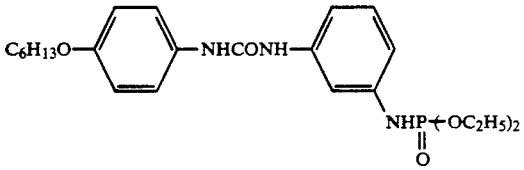
(F-9)
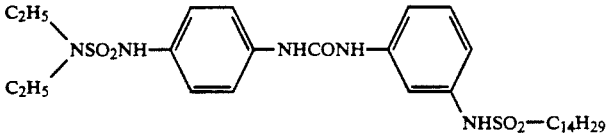
(F-10)
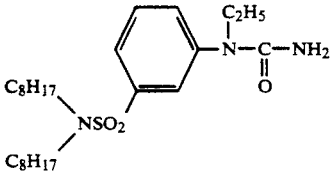
(F-11)
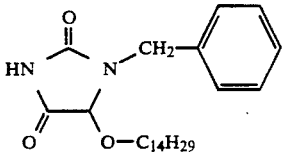
(F-12)
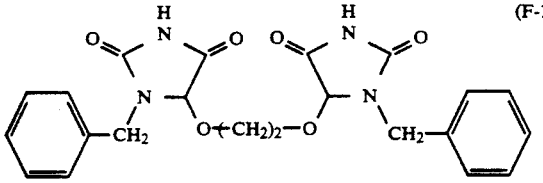
(F-13)
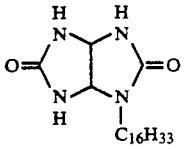
(F-14)
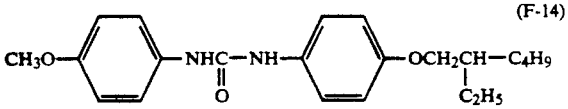
(F-15)
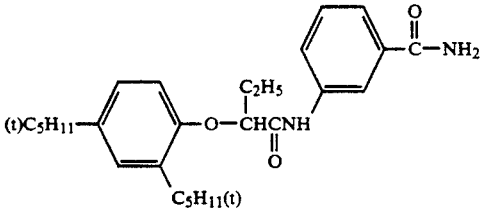

-continued (F-16)

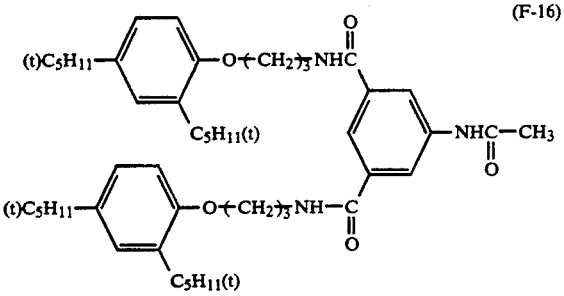

(F-17)

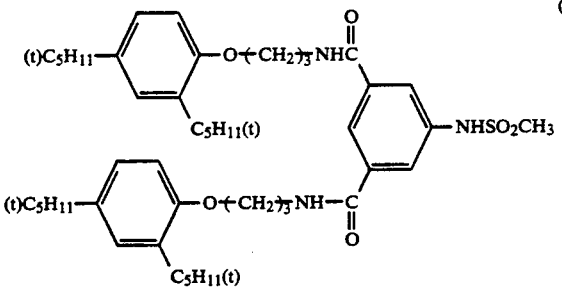

(G) Compounds that can break aggregation of photographic sensitizing dyes

In the field of sensitizing dyes for photography, a group of compounds that break the J-band, so that desorption may occur easily, are known as described in Japanese Patent Application No. 112169/1988. The group of compounds described in that specification are mainly water-soluble compounds, which are designed to be used by adding to a developing solution.

In order to break the aggregation of pyrazoloazole azomethine dyes, which is aimed at by the present invention, it is preferable that the particular compound is contained in the film and is soluble in oils. This can be attained by substituting compounds proposed in Japanese Patent Application No. 112169/1988, as skeletons of the compounds, by an oil-soluble substituent. Preferable skeletons used in the present invention are selected from those represented by the following formulae (IV), (V), (VI), and (VII):

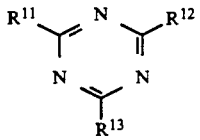

Formula (IV)

wherein $R^{11}$, $R^{12}$, and $R^{13}$, which may be the same or different, each represent a hydrogen atom, a halogen atom, a substituted or unsubstituted alkyl group, a substituted or unsubstituted aryl group, a substituted or unsubstituted amino group, a substituted or unsubstituted alkoxy group, a substituted or unsubstituted aryloxy group, a substituted or unsubstituted alkylthio group, or a substituted or unsubstituted arylthio group, and the total number of carbon atoms of $R^{11}$, $R^{12}$, and $R^{13}$ is 10 or over.

$$A_1\text{-}(L)_n\text{-}B_1$$ Formula (V)

wherein $A_1$ and $B_1$, which may be the same or different, each represent a substituted or unsubstituted heterocyclic residue, L represents a divalent linking group, and n is 0 or 1.

As the heterocyclic residues represented by $A_1$ and $B_1$, 5-, 6-, or 7-membered rings are preferable, and condensed rings formed thereby are also possible. They may be substituted.

The linking group represented by L is preferably an aliphatic or aromatic divalent organic residue that may be substituted, or an oxygen atom, a sulfur atom, or a selenium atom.

Examples of the heterocyclic residues represented by $A_1$ and $B_1$ are a furyl group, a thienyl group, a pyrrolyl group, a triazinyl group, a triazolyl group, an imidazolyl group, a pyridyl group, a pyrimidyl group, a pyrazinyl group, a quinazolinyl group, a purinyl group, a qunolinyl group, an acridinyl group, an indolyl group, a thiazolyl group, an oxazolyl group, and a furazanyl group.

Examples of the organic residue of the linking group represented by L include, for example, a methylene group, an ethylene group, a phenylene group, a propylene group, a 1-oxo-2-butenyl-1,3-ene group, a p-xylene-α,α'-diyl group, an ethylenedioxy group, a succinyl group, and a malonyl group.

The total number of carbon atoms of $A_1$, $B_1$, and L is 15 or over.

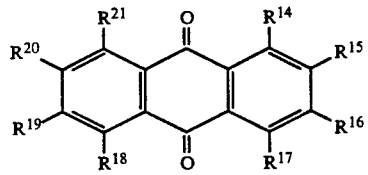

Formula (VI)

wherein $R^{14}$, $R^{15}$, $R^{16}$, $R^{17}$, $R^{18}$, $R^{19}$, $R^{20}$, and $R^{21}$, which may be the same or different, each represent a hydrogen atom, a halogen atom, a hydroxyl group, a substituted or unsubstituted alkyl group, a substituted or unsubstituted aryl group, a substituted or unsubstituted alkoxy group, a substituted or unsubstituted amino group, a cyano group, a carboxyl group, a substituted or unsubstituted aryloxy group, a substituted or unsubstituted alkylthio group, a substituted or unsubstituted arylthio group, a substituted or unsubstituted sulfonamido group, a substituted or unsubstituted acylamino group, a substituted or unsubstituted acyl group, a substituted or unsubstituted sulfamoyl group, a substituted or unsubstituted alkoxycarbonyl group, a substituted or unsubstituted aryloxycarbonyl group, or a substituted or unsubstituted carbamoyl group, and the total number of carbon atoms of $R^{14}$, $R^{15}$, $R^{16}$, $R^{17}$, $R^{18}$, $R^{19}$, $R^{20}$, and $R^{21}$ is 10 or over.

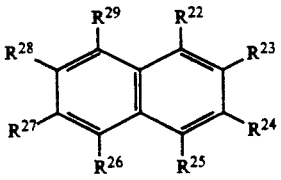

Formula (VII)

wherein $R^{22}$, $R^{23}$, $R^{24}$, $R^{25}$, $R^{26}$, $R^{27}$, $R^{28}$, and $R^{29}$, which may be the same or different, each represent a hydrogen atom, a halogen atom, a hydroxyl group, a substituted or unsubstituted alkyl group, a substituted or unsubstituted aryl group, a substituted or unsubstituted alkoxy group, a substituted or unsubstituted amino group, a mercapto group, a cyano group, a carboxyl group, a substituted or unsubstituted aryloxy group, a substituted or unsubstituted alkylthio group, a substituted or unsubstituted arylthio group, a substituted or unsubstituted acylamino group, a substituted or unsubstituted sulfonamido group, a substituted or unsubstituted acyl group, a substituted or unsubstituted sulfamoyl group, a substituted or unsubstituted carbamoyl group, a substituted or unsubstituted alkoxycarbonyl group, or a substituted or unsubstituted aryloxycarbonyl group, and the total number of carbon atoms of $R^{22}$ through $R^{29}$ is 10 or over, with the exception that $R^{21}$, $R^{25}$, $R^{26}$, or $R^{29}$ is not a hydroxyl group.

Besides formula (IV), (V), (VI), or (VII), bicyclic to tetracyclic heterocyclic compounds are included.

As the heterocyclic compounds can be mentioned compounds wherein at least one of the atoms that constitute the ring is an oxygen atom, a nitrogen atom, or a sulfur atom. Preferable bicyclic to tetracyclic heterocyclic rings are benzothiazole, benzoxazole, benzoselenazole, benzotetrazole, benzoimidazole, indole, isoindole, indolenine, indazole, chromene, chroman, isochroman, quinoline, isoquinoline, quinolizine, cinnoline, phthalazine, quinazoline, quinoxaline, naphthyridine, purine, pteridine, indolizine, benzofuran, isobenzofuran, benzothiophene, benzopyran, benzoazepine, benzoxazine, cyclopentapyran, cycloheptaisooxazole, benzothiazepine, pyrazolotriazole, tetraazaindene, naphthothiazole, naphthoselenazole, naphthotellurazole, naphthoimidazole, carbazole, xanthene, phenanthridine, acridine, perimidine, phenanthroline, thianthrene, phenoxthine, phenoxazine, phenothiazine, and phenazine, and polycyclic compounds formed by condensing, to these heterocyclic rings, cyclic hydrocarbons, such as benzene, and naphthalene or heterocyclic rings, such as furan, thiophene, pyrrole, pyran, thiopyran, pyridine, oxazole, isooxazole, thiazole, isothiazole, imidazole, pyrazole, pyrazine, pyrimidine, and pyridazine.

In the present invention, ones having heterocyclic rings as shown below are preferable.

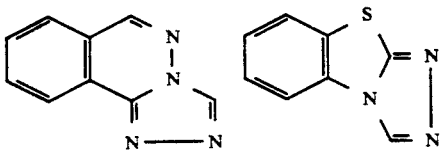

-continued

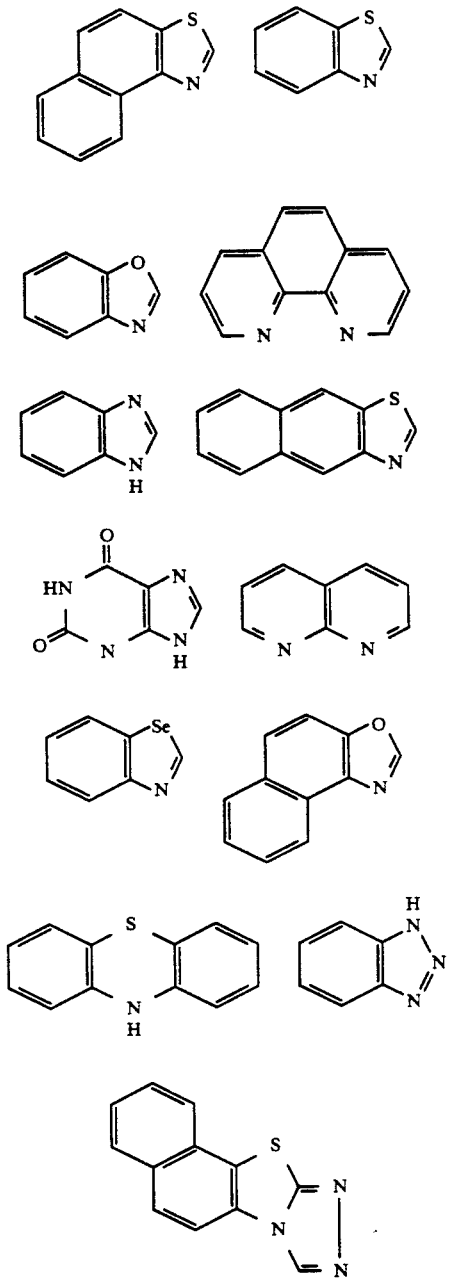

The total number of carbon atoms of the substituents attached to these bicyclic to tetracyclic heterocyclic rings is 10 or over.

Chemical structures of formula (IV), (V), (VI), and (VII), and bicyclic to tetracyclic heterocyclic compounds are given below, but the present invention is not limited to them.

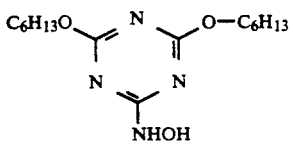

(G-1)

-continued (G-2)

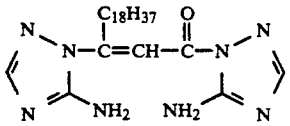

(G-3)

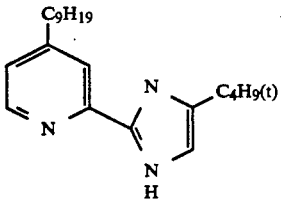

(G-4)

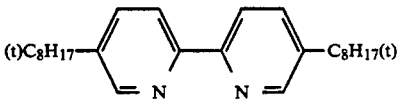

(G-5)

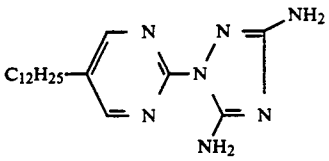

(G-6)

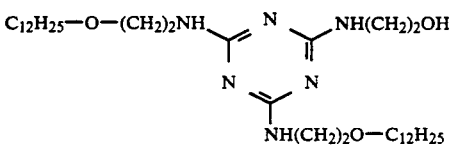

(G-7)

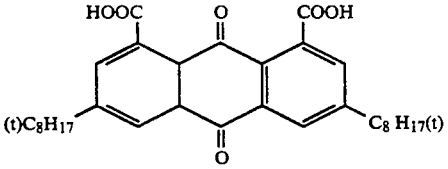

(G-8)

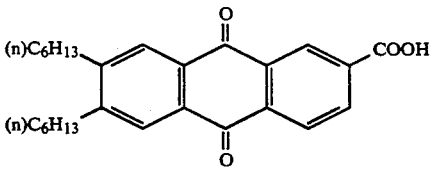

(G-9)

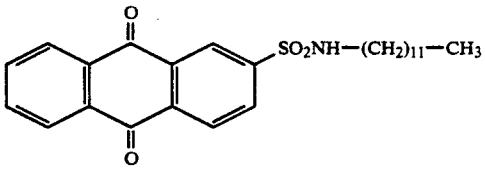

(G-10)

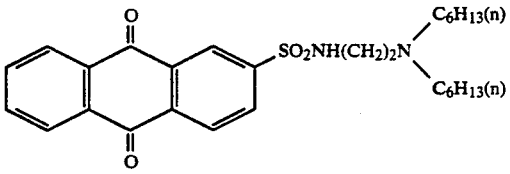

-continued (G-11)

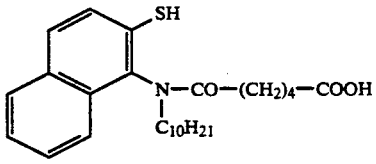

(G-12)

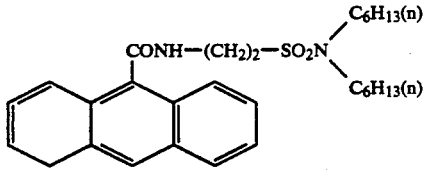

(G-13)

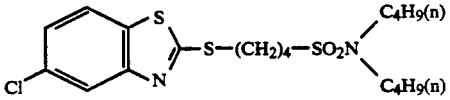

(G-14)

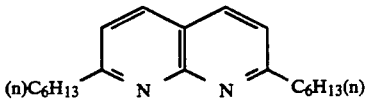

(G-15)

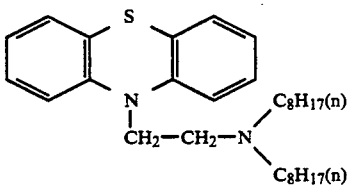

(G-16)

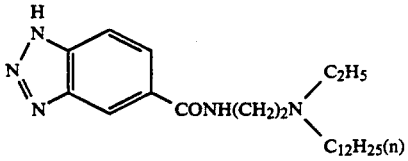

(G-17)

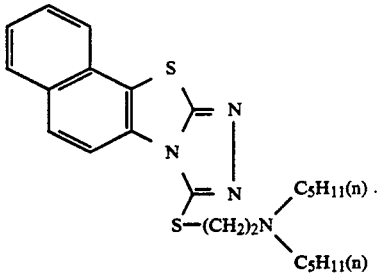

(G-18)

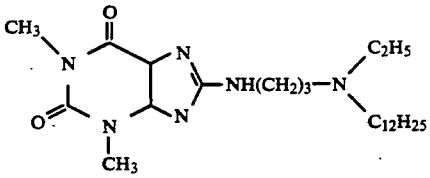

(H) 2-(2-hydroxyphenyl)benzotriazole compounds

It is disclosed in JP-B No. 13658/1987 that 1-(2-hydroxyphenyl)benzotriazole compounds are effective in preventing dark/heat fading of indoaniline cyan dyes formed from 1-acylamino-5-alkyl-6-chlorophenols.

It has been recognized that when a 2-(2-hydroxyphenyl) benzotriazole compound is added, light fading of the pyrazoloazole azomethine dyes of the present invention can be prevented effectively.

Preferable 2-(2-hydroxyphenyl)benzotriazole compounds are represented by the following formula:

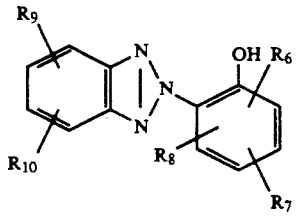

wherein $R_6$, $R_7$, $R_8$, $R_9$, and $R_{10}$, which may be the same or different, each represent a hydrogen atom, a halogen atom, a nitro group, a hydroxyl group, an alkyl group, an alkenyl group, an aryl group, an alkoxy group, an alkoxycarbonyl group, an aryloxy group, an alkylthio group, an arylthio group, a monoalkylamino group, a dialkylamino group, an acylamino group, a sulfonamido group, or a 5- or 6-membered heterocyclic group containing oxygen or nitrogen.

Examples of these compounds are given below, but the present invention is not limited to them.

(H-1)

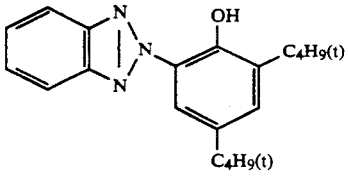

(H-2)

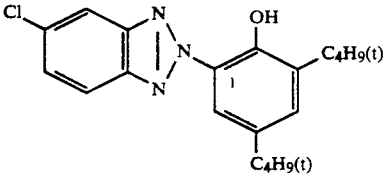

(H-3)

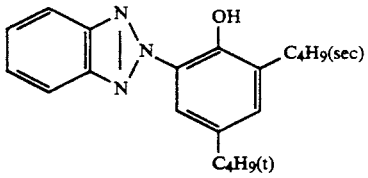

(H-4)

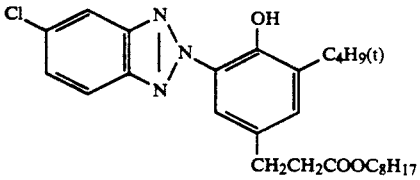

(H-5)

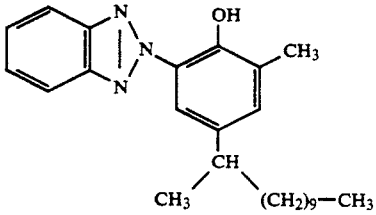

-continued (H-6)

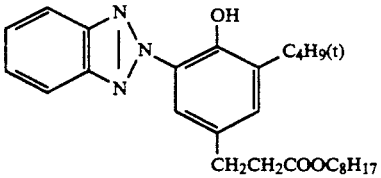

(H-7)

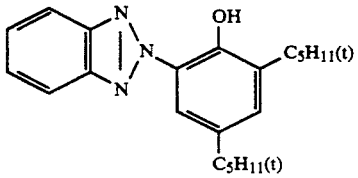

(H-8)

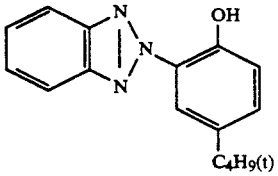

(H-9)

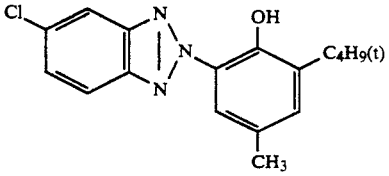

(H-10)

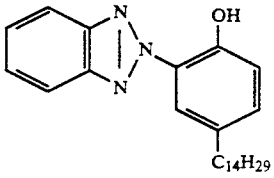

(H-11)

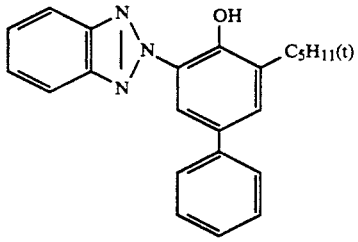

(H-12)

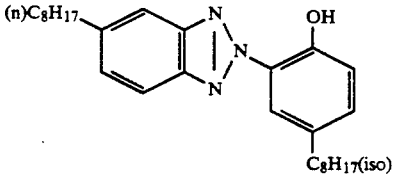

(H-13)

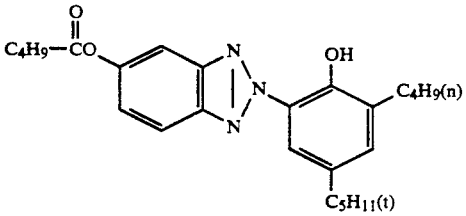

-continued (H-14)

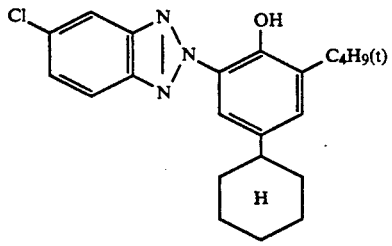

(H-15)

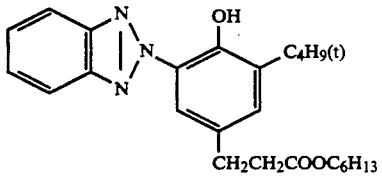

(H-16)

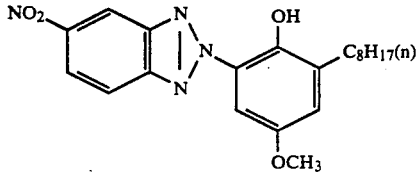

(H-17)

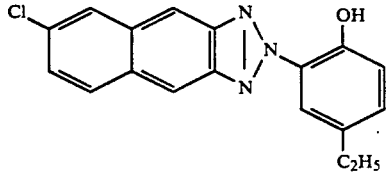

(H-18)

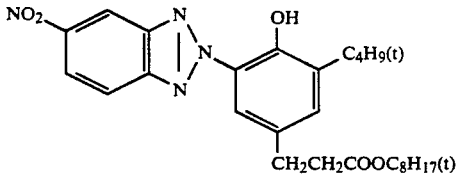

(H-19)

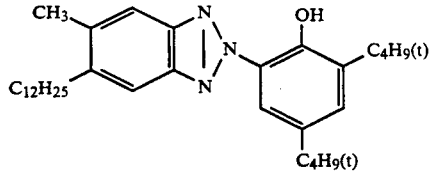

(H-20)

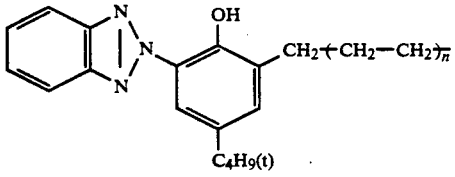

Compounds that can break the aggregation of azomethine dyes used in the present invention are those that have a function for disbanding (breaking) aggregation of materials, and the function itself can be easily confirmed by measuring the visible absorption spectrum, indicating the concentration dependency. These compounds that can break the aggregation of methine dyes, particularly those compounds falling in the concepts described under (A) to (H) above, are used in the range of 5 to 300 mol %, and preferably 10 to 150 mol %, for the magenta coupler in the present invention together with the magenta coupler.

Compounds that can break the aggregation of azomethine dyes may be used alone or in combination for the coupler.

The pyrazoloazole magenta coupler of the present invention and the compound that can break the aggregation of azomethine dye may be caused to be present together with at least one high-boiling organic solvent, and they may be dispersed to be contained in the silver halide emulsion layer. Preferably high-boiling organic solvents having the following formulae (I) to (M) are used.

Preferably the average grain diameter of the grains of the emulsified product is 0.3 μm or below, and more preferably 0.2 μm or below.

Formula (I)

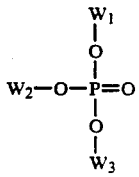

Formula (J)

$$W_1-COO-W_2$$

Formula (K)

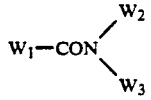

Formula (L)

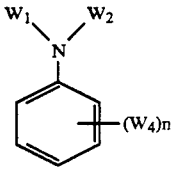

Formula (M)

$$W_1-O-W_2$$

wherein $W_1$, $W_2$, and $W_3$ each represent a substituted or unsubstituted alkyl group, cycloalkyl group, alkenyl group, aryl group, or heterocyclic group, $W_4$ represents $W_1$, $OW_1$, or $S-W_1$, n is an integer of 1 to 5, and when n is 2 or over, $W_4$'s may be the same or different. In formula (M), $W_1$ and $W_2$ may together form a condensed ring. Details of these high-boiling organic solvents are described in JP-A No. 215272/1987, in the right lower column on page 137 to the right upper column on page 144.

Major chemical structures of these high-boiling organic solvents are given below.

$$O=P-(O-C_4H_9\text{-}n)_3 \quad \text{(P-1)}$$

$$O=P-(O-C_6H_{13}\text{-}n)_3 \quad \text{(P-2)}$$

(P-3)

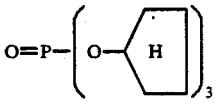

-continued
(P-4)
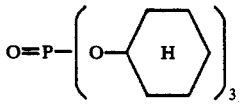
(P-5)
$O{=}P{-}(O{-}C_8H_{17}\text{-n})_3$
(P-6)
$O{=}P{-}(OCH_2CH(C_2H_5){-}C_4H_9\text{-n})_3$
(P-7)
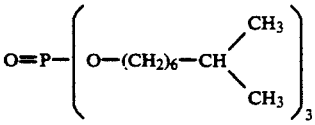
(P-8)
$O{=}P{-}(O{-}C_9H_{19}\text{-iso})_3$
(P-9)
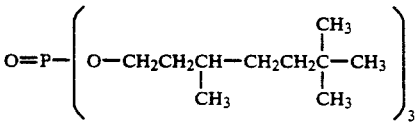
(P-10)
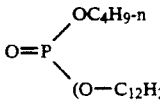
(P-11)
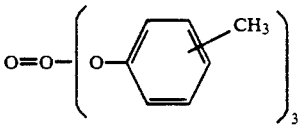
(P-12)
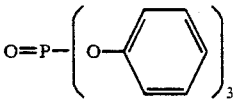
(P-13)
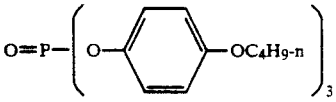
(P-14)
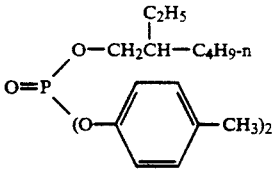
(P-15)
$O{=}P{-}[O{-}(CH_2)_5CH{-}CH_2]_3$
(P-16)
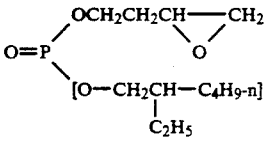
(P-17)
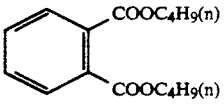
-continued
(P-18)
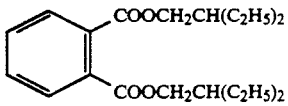
(P-19)
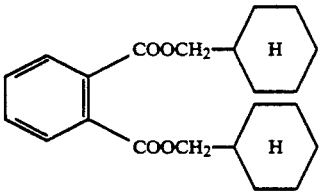
(P-20)
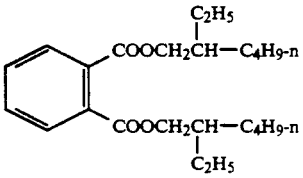
(P-21)
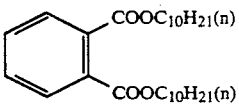
(P-22)
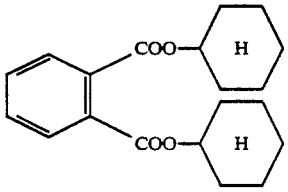
(P-23)
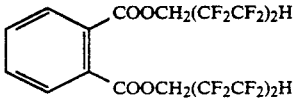
(P-24)
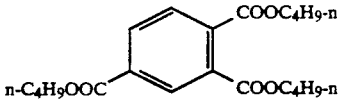
(P-25)
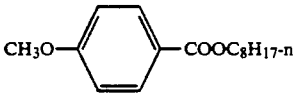
(P-26)
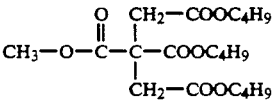
(P-27)
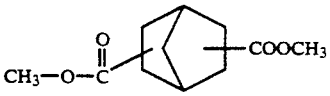

-continued (P-28)

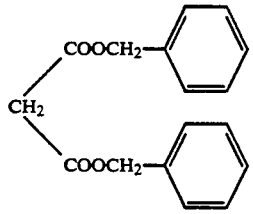

(P-29)

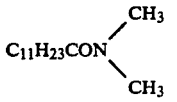

(P-30)

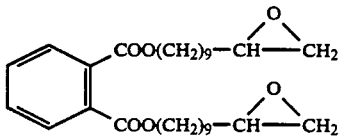

(P-31)

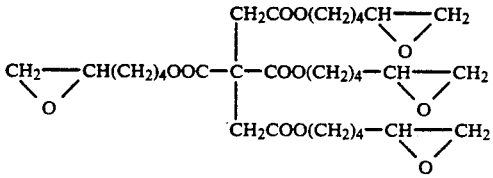

(P-32)

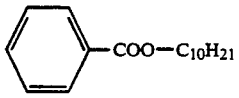

(P-33)

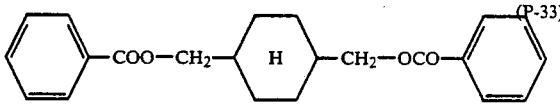

(P-34)

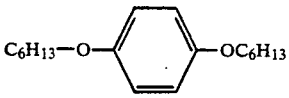

(P-35)

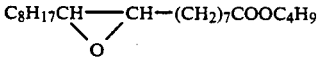

(P-36)

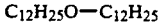

(P-37)

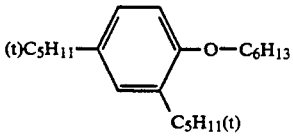

(P-38)

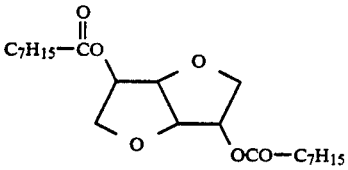

(P-39)

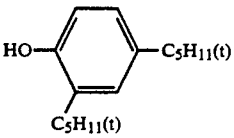

-continued (P-40)

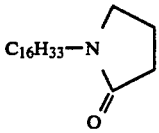

(P-41)

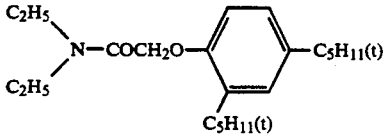

(P-42)

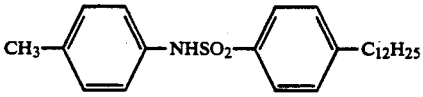

(P-43)

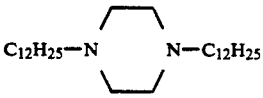

(P-44)

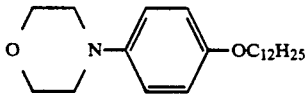

High-boiling organic solvents of other types that can be used effectively for the couplers of the present invention include N,N-dialkylaniline derivatives. In particular, those wherein an alkoxy group is attached to the ortho-position to the N,N-dialkylamino group are preferable. Specific examples are the following compounds:

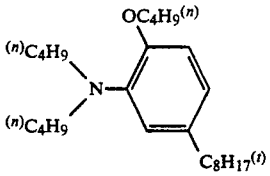

This type of high-boiling organic solvent is effective in preventing magenta stain from occurring in the white background of the processed color print with time, and in preventing fogging due to development. The amount to be used is generally in the range of 10 to mol %, and preferably in the range of 20 to 300 mol %, for the coupler.

These couplers, in the presence or absence of the high-boiling organic solvent mentioned above, can be impregnated into a loadable latex polymer (e.g., U.S. Pat. No. 4,203,716), or dissolved in a polymer that is insoluble in water but is soluble in the organic solvent, and they can be emulsified and dispersed in a hydrophilic colloid aqueous solution.

Preferably, monopolymers or copolymers described in International Publication No. 88/00723, pages 12 to 30, are used, and in particular, the use of acrylamide polymers are preferable, for example, in view of the stabilization of the image dye.

Specific examples are the following compounds:

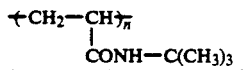

(average molecular weight of 50,000.)

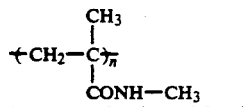

(average molecular weight of 60,000.)

The color photographic material of the present invention has preferably, on the base, a blue-sensitive silver halide emulsion layer, a green-sensitive silver halide emulsion layer, and a red-sensitive silver halide emulsion layer, applied in the stated order or in any other order.

As the silver halide used in the present invention can be mentioned silver chloride, silver bromide, silver (bromo) chloroiodide, and silver bromoiodide, with silver chloride and silver (bromo)chloroiodide being preferable. The halogen composition of the silver halide grains in one emulsion layer is preferably silver chlorobromide, wherein 90 mol % or over of all the silver halides constituting the silver halide grains are silver chloride, and which is substantially free from silver iodide. Herein the term "substantially free from silver iodide" means that the silver iodide content is 1.0 mol % or less. A particularly preferable halogen composition of the silver halide grains is silver bromochloride, wherein 95 mol % or over of all the silver halides is silver chloride constituting the silver halide grains, and which is substantially free from silver iodide.

The silver halide grains of the present invention can be formed with localized phases by reacting at least 10 mol silver bromide in terms of silver bromide content by the double-jet method. Localized phases can be formed by the so-called conversion method, which includes a step of converting an already formed silver halide into a silver halide whose solubility product is smaller. Alternatively, localized phases can be formed by adding finely divided silver bromide particles, thereby causing recrystallization on the surface of silver chloride grains to occur.

These methods are described, for example, in European Patent (Publication) No. 273,430.

When the localized phases of the silver halide grains of the present invention or the substrates thereof are allowed to include metal ions other than silver ions (e.g., ions of metals of Group VIII of the Periodic Table, and ions of transition metal Group II of the Periodic Table, lead ions, and thallium ions), it is preferable because the effect of the present invention is more improved. In the localized phases, for example, iridium ions, rhodium ions, and iron ions may be used mainly, and in the substrates, for example, combinations of ions of metals selected from the group consisting of osmium, iridium, rhodium, platinum, ruthenium, palladium, cobalt, nickel, and iron, or combinations of their complex ions may be used mainly. The type and the concentration of the ions in the localized phase may be different from those in the substrate. To incorporate metals ions in localized phases and/or other grain parts (substrates) of silver halide grains, the metal ions may be added to the adjusted solution before or during the formation of the grains, or during the physical ripening. For example, metal ions may be added to an aqueous gelatin solution, an aqueous halide solution, an aqueous silver salt solution, or other aqueous solution to form silver halide grains. Alternatively, it is also possible that metal ions are previously contained in finely divided silver halide particles, then the mixture is added to a desired silver halide emulsion, and the finely divided silver halide particles are dissolved so that the metal ions may be introduced. This technique is effective particularly when metal ions are to be introduced to silver bromide localized phases present on the surfaces of silver halide grains. The way of adding metal ions may be suitably changed depending on which part of silver halide grains the metal ions should be present. Particularly, it is preferable that the localized phases are deposited together with at least 50% of all iridium that is added at the time of the adjustment of the silver halide grains. The expression "the localized phases are deposited together with iridium ions" means that an iridium compound is added simultaneously with, immediately before, or immediately after the supply of silver and/or halogen for the formation of the localized phases.

As silver halide grains involved in the present invention, ones including (100) planes or (111) planes, or ones including both of them, or even ones including higher planes, may be preferably used.

With respect to the shape of the silver halide grains to be used in the present invention, there are regular crystal shapes, such as a cubic shape, a tetradecahedral shape, and an octahedral shape, and irregular crystal shapes, such as a spherical shape and a tabular shape, and composite shapes of these. A mixture of grains having various crystal shapes can be used, and particularly it is desirable to use a mixture of grains wherein 50% or over, preferably 70% or over, and more preferably 90% or over, are in the shape of a cube, tetradecahedron, or octahedron.

The silver halide emulsion to be used in the present invention may be an emulsion wherein tabular grains having an aspect ratio (a length/thickness ratio) of 5 or over, and particularly preferably 8 or over, occupy 50% or over of the total projected area of the grains.

Although it is good if the size of the silver halide grains used in the present invention is within the range that is generally used, preferably the average grain size of the silver halide grains used in the present invention is 0.1 to 1.5 μm.

The grain diameter distribution may be a polydisperse or monodisperse distribution, with monodisperse distribution preferable. It is preferable that the grain size distribution showing the degree of the monodisperse distribution is such that the statistical deviation coefficient (the value s/d obtained by dividing the standard deviation s by the diameter d with the projected area approximated to a circle) is 20% or below, and more preferably 15% or below.

Two or more such tabular grain emulsions and monodisperse emulsions may be mixed. When emulsions are mixed, it is preferable that at least one of the emulsions has the above deviation coefficient, and more preferably the deviation coefficient of the mixed emulsion fills in the range of the above values.

A part other than the localized phase of the silver halide grains used in the present invention, that is, the so-called substrate part, may be such that the inside and the surface layer are different or uniform in phase.

The silver halide emulsion used in the present invention is generally one that has been physically ripened, chemically ripened, and spectrally sensitized.

With respect to chemical sensitizers used for chemical ripening, those described in JP-A No. 215272/1987, in the right lower column on page 18 to the right upper column on page 22, are preferably used, and with respect to spectral sensitizers, those described in JP-A No. 215272/1987, in the right upper column on page 22 to page 38, are preferably used.

With respect to antifoggants or stabilizers used during the production or storage of the silver halide emulsion used in the present invention, those described in JP-A No. 215272/1987, page 39 to page 72 (the right upper column), are preferably used.

Yellow couplers, magenta couplers, and cyan couplers that will couple with the oxidized product of aromatic amine color-developing agents to form yellow, magenta, and cyan are generally used in the color photographic material.

Of yellow couplers that can be used in the present invention, acylacetamide derivatives, such as pivaloylacetanilide and benzoylacetanilide, are preferable.

As the yellow coupler, among others, couplers represented by the following formulae (Y-1) and (Y-2) are preferable:

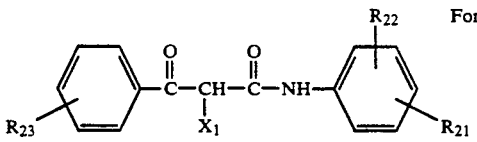

Formula (Y-1)

-continued

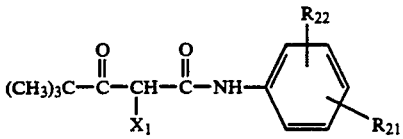

Formula (Y-2)

wherein $X_1$ represents a hydrogen atom or a group capable of being released upon coupling reaction, $R_{21}$ represents a ballast group having 8 to 32 carbon atoms in all, $R_{22}$ represents a hydrogen atom, one or more halogen atoms, a lower alkyl group, a lower alkoxy group, or a ballast group having 8 to 32 carbon atoms in all, $R_{23}$ represents a hydrogen atom or a substituent, and if there are two or more $R_{23}$'s, they may be the same or different.

Details of pivaloylacetanilide-type yellow couplers are described in U.S. Pat. No. 4,622,287 (column 3, line 15 to column 8, line 39) and U.S. Pat. No. 4,623,616 (column 14, line 50 to column 19, line 41).

Details of benzoylacetanilide-type yellow couplers are described in U.S. Pat. Nos. 3,408,194, 3,933,501, 4,046,575, 4,133,958, and 4,401,752.

Specific examples of pivaloylacetanilide-type yellow couplers are compound examples (Y-1) to (Y-39), described in the above-mentioned U.S. Pat. No. 4,622,287 (columns 37 to 54), and among others, (Y-1), (Y-4), (Y-6), (Y-7), (Y-15), (Y-21), (Y-22), (Y-23), (Y-26), (Y-35), (Y-36), (Y-37), (Y-38), and (Y-39) are preferable.

Further, compound examples (Y-1) to (Y-33), described in the above-mentioned U.S. Pat. No. 4,623,616 (columns 19 to 24), can be mentioned, and among others, for example (Y-2), (Y-7), (Y-8), (Y-12), (Y-20), (Y-21), (Y-23), and (Y-29) are preferable.

Other preferable compounds include a typical example (34) described in U.S. Pat. No. 3,408,194 (column 6), compound examples (16) and (19) described in U.S. Pat. No. 3,933,501 (column 8), compound example (9) described in U.S. Pat. No. 4,046,575 (columns 7 to 8), compound example (1) described in U.S. Pat. No. 4,133,958 (columns 5 to 6), compound example 1 described in U.S. Pat. No. 4,401,752 (column 5), and compounds (a) to (h) given below.

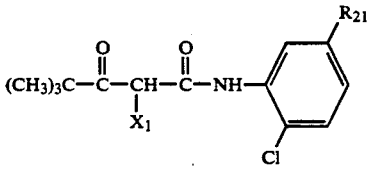

| Compound | $R_{21}$ | $X_1$ |
|---|---|---|
| a | $-CO_2CH(CH_3)CO_2C_{12}H_{25}$ | 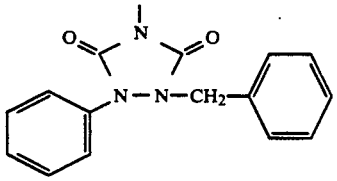 |
| b | $-CO_2CH(C_4H_9)CO_2C_{12}H_{25}$ | The same as the above |

-continued

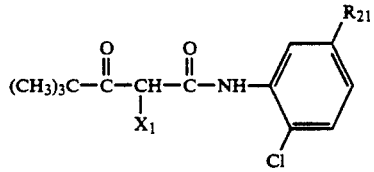

| Compound | $R_{21}$ | $X_1$ |
|---|---|---|
| c | 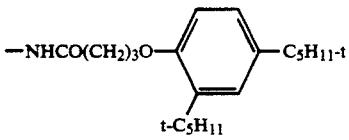 | 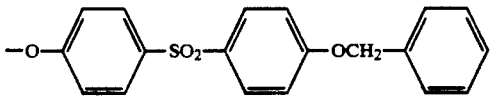 |
| d | The same as the above | 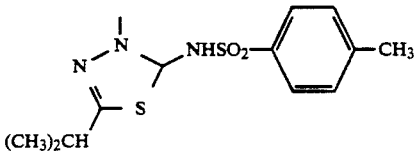 |
| e | The same as the above | 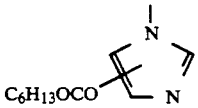 |
| f | $-NHSO_2C_{12}H_{25}$ | 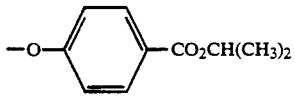 |
| g | $-NHSO_2C_{16}H_{33}$ | 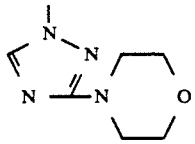 |
| h | $-NHCO\underset{\underset{CH_3}{\vert}}{C}HCH_2SO_2C_{12}H_{25}$ | 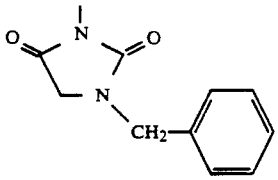 |

Of the above couplers, those containing a group capable of being released upon coupling bonds through a nitrogen atom are particularly preferable.

Other magenta couplers used in combination with the pyrazoloazole series coupler in the present invention include oil-protected-type indazolone couplers, cycanoacetyl couplers, preferable 5-pyrozolone couplers, and pyrazoloazole couplers, such as pyrazolotriazoles. Among 5-pyrazolone couplers, couplers wherein an arylamino group or an acylamino group is substituted at the 3-position are preferable in view of the color density and the hue of the color-developed dye, and typical examples thereof are described, for example, in U.S. Pat. Nos. 2,311,082, 2,343,703, 2,600,788, 2,908,573, 3,062,653, 3,152,896, and 3,936,015. As the group capable of being released from 2-equivalent 5-pyrazolone couplers, nitrogen-linked coupling releasable groups, described in U.S. Pat. No. 4,310,619, and arylthio groups, described in U.S. Pat. No. 4,351,897, are preferable. 5-pyrazolone couplers having a ballast group described in European Patent No. 73,636 can give a high color density.

As pyrazoloazole series couplers can be mentioned pyrazolobenzimidazoles, described in U.S. Pat. No. 2,369,879, preferable pyrazolo[5,1-c][1,2,4]triazoles, described in U.S. Pat. No. 3,725,067, pyrazolotetrazoles, described in *Research Disclosure* 24220 (June 1984), and pyrazolopyrazoles, described in *Research Disclosure* 24230 (June 1984).

These compounds can be represented specifically by the following formulas (N-I), (N-II), or (N-III):

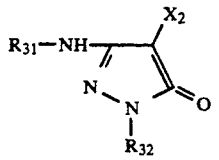

Formula (N-I)

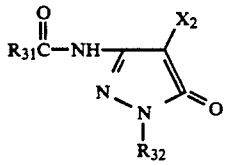

Formula (N-II)

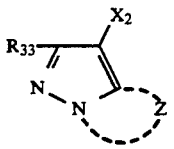

Formula (N-III)

wherein $R_{31}$ represents a ballast group having 8 to 32 carbon atoms in all, $R_{32}$ represents an optionally substituted phenyl group, $R_{33}$ represents a hydrogen atom or a substituent, Z represents a group of non-metal atoms required for forming a 5-membered azole ring containing 2 to 4 nitrogen atoms that may have a substituent (inclusive of a condensed ring), and $X_2$ represents a hydrogen atom or a group capable of being released upon coupling.

Details of the substituents represented by $R_{33}$ and the substituents that will be possessed by the azole ring are described in U.S. Pat. No. 4,540,654 (column 2, line 41 to column 8 line 27).

Of pyrazoloazole series couplers, imidazo[1,2-b]pyrazoles, described in U.S. Pat. No. 4,500,630, and pyrazolo[1,5-b][1,2,4]triazoles, described in U.S. Pat. No. 4,540,654, are particularly preferable in view of the lowness in the yellow subsidiary absorption of the color-developed dye, and the light-fastness.

In addition, pyrazolotriazole couplers, wherein branched alkyl groups are attached directly to 2-, and 3-or 6-positions of the pyrazolotriazole ring, as described in JP-A No. 65245/1986, pyrazoloazole couplers containing a sulfonamido group in the molecule, described in JP-A No. 65246/1986, pyrazoloazole couplers having an alkoxyphenylsulfonamido ballast group, as described in JP-A No. 147254/1986, and pyrazolotriazole couplers having an alkoxy group or an aryloxy group at the 6-position, described in European Patent (Publication) No. 226,849, are preferably used.

As the cyan coupler, phenol series cyan couplers and naphthol series cyan couplers are the most typical.

The phenol series cyan coupler includes those which have an acylamino group at the 2-position of the phenol nucleus, and an alkyl group at the 5-position of the phenol nucleus (inclusive of polymer couplers) described, for example, in U.S. Pat. Nos. 2,369,929, 4,518,687, 4,511,647, and 3,772,002, and as typical examples thereof can be mentioned the coupler described in Example 2 in Canadian Patent No. 625,822, Compound (1) described in U.S. Pat. No. 3,772,002, Compounds (1-4) and (1-5) described in U.S. Pat. No. 4,564,590, Compounds (1), (2), (3), and (4) described in JP-A 39045/1986, and Compound (C-2) described in JP-A No. 70846/1987.

The phenol series cyan coupler includes 2,5-diacylaminophenol couplers described in U.S. Pat. Nos. 2,772,162, 2,895,826, 4,334,011, and 4,500,653, and JP-A No. 164555/1984, and as typical examples thereof can be mentioned Compound (V) described in U.S. Pat. No. 2,895,826, Compound (17) described in U.S. Pat. No. 4,557,999, Compounds (2) and (12) described in U.S. Pat. No. 4,565,777, Compound (4) described in U.S. Pat. No. 4,124,396, and Compound (1-19) described in U.S. Pat. No. 4,613,564.

The phenol series cyan coupler also includes those described in U.S. Pat. Nos. 4,372,173, 4,564,586, and 4,430,423, JP-A Nos. 390441/1986 and 257158/1987, wherein a nitrogen-containing heterocyclic ring is condensed to the phenol nucleus, and as typical examples thereof can be mentioned Couplers (1) and (3) described in U.S. Pat. No. 4,327,173, Compounds (3) and (15) described in U.S. Pat. No. 4,564,586, Compounds (1) and (3) described in U.S. Pat. No. 4,430,423, and compounds given below:

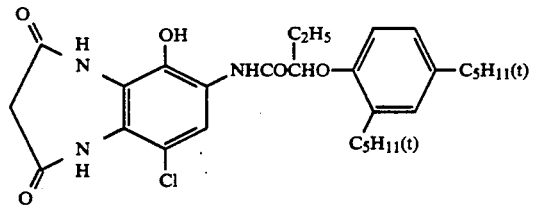

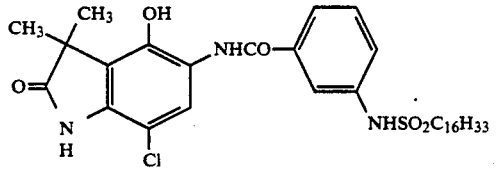

-continued
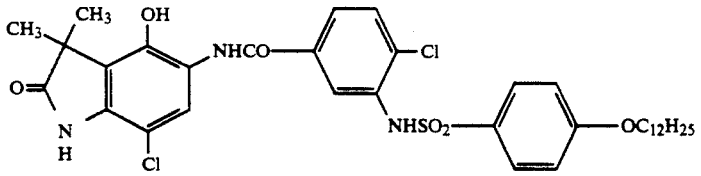
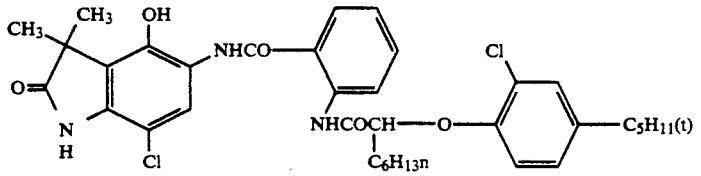
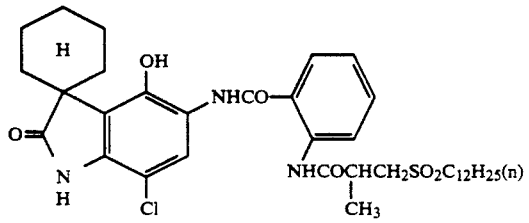
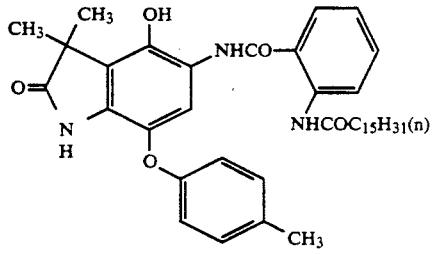
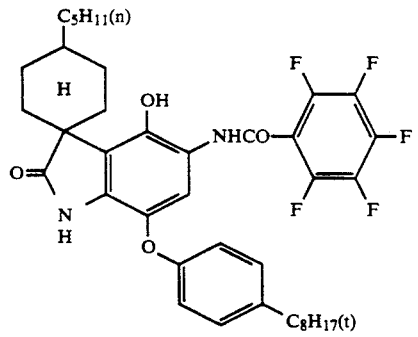
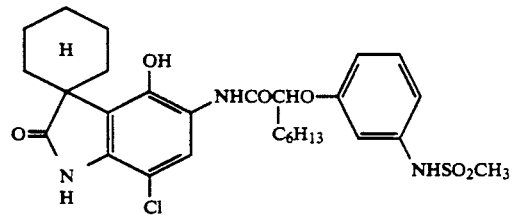
In addition to the cyan couplers of the above types, for example, diphenylimidazole cyan couplers described in European Patent Application Publication EP 0,249,453A2 can be used.

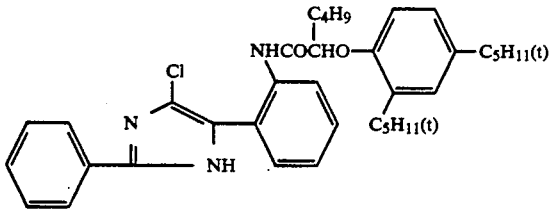

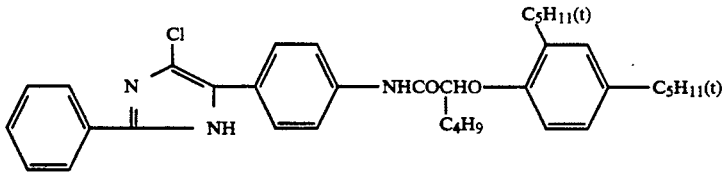

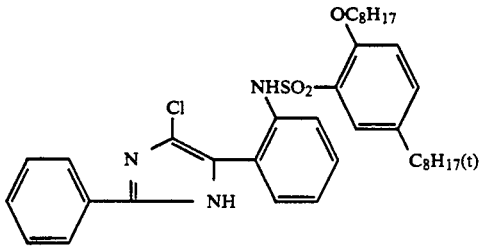

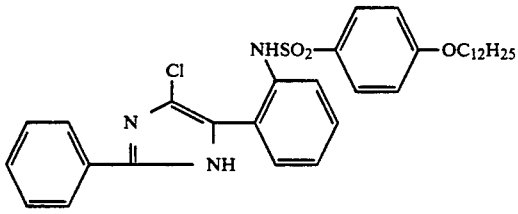

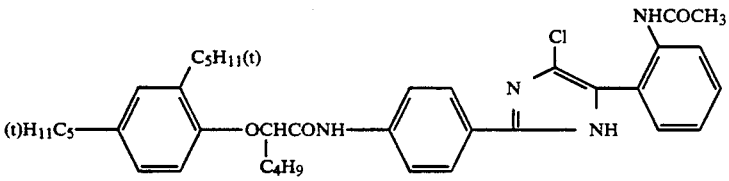

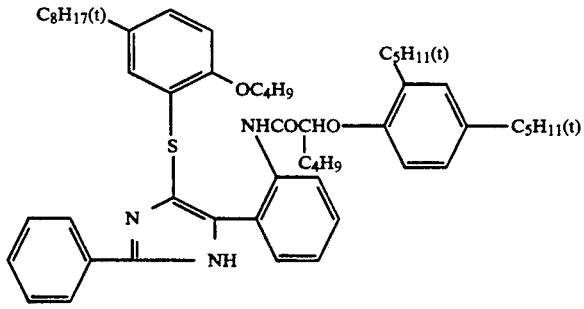

The phenol series cyan couplers further includes ureide series couplers described, for example, in U.S. Pat. Nos. 4,333,999, 4,451,559, 4,444,872, 4,427,767, and 4,579,813, and European Patent (EP) 067,689B1, and as typical examples thereof can be mentioned Coupler (7) described in U.S. Pat. No. 4,333,999, Coupler (1) described in U.S. Pat. No. 4,451,559, Coupler (14) described in U.S. Pat. No. 4,444,872, Coupler (3) described in U.S. Pat. No. 4,427,767, Couplers (6) and (24) described in U.S. Pat. No. 4,609,619, Couplers (1) and (11) described in U.S. Pat. No. 4,579,813, Couplers (45) and (50) described in European Patent (EP) 067,689B1, and Coupler (3) described in JP-A No. 42658/1986.

The naphthol series cyan coupler includes, for example, those having an N-alkyl-N-arylcarbamoyl group at the 2-position of the naphthol nucleus (e.g., see U.S. Pat. No. 2,313,586), those having an alkylcarbamoyl group at the 2-position (e.g., see U S. Pat. Nos. 2,474,293, and 4,282,312), those having an arylcarbamoyl group at the 2-position (e.g., see JP-B ("JP-B" means examined Japanese patent publication) No. 14523/1975), those having a carbonamido group or a sulfonamido group at the 5-position (e.g., see JP-A Nos. 237448/1985, 145557/1986, and 153640/1986), those having an aryloxy-coupling split-off group (e.g., see U.S. Pat. No. 3,476,563), those having a substituted alkoxy-coupling split-off group (e.g., see U.S. Pat. No. 4,296,199), and those having a glycolic acid-coupling split-off group (e.g., see JP-B No. 39217/1985).

The photographic material that is prepared according to the present invention may contain, as a color antifoggant, for example, a hydroquinone derivative, an aminophenol derivative, a gallic acid derivative, or an ascorbic acid derivative. In the photographic material of the present invention, various anti-fading agents (discoloration preventing agents) can be used. As organic anti-fading agents for cyan, magenta, and/or yellow images, typical examples are hydroquinones, 6 -hydroxychromans, 5-hydroxycoumarans, spirochromans, p-alkoxyphenols, hindered phenols, including bisphenols, gallic acid derivatives, methylenedioxybenzenes, aminophenols, and hindered amines, and ether or ester derivatives thereof, obtained by silylating or alkylating the phenolic hydroxyl group of these compounds. Metal complexes such as (bissalicylaldoxymato)nickel complexes, and (bis-N,N-dialkyldithiocarbamato)nickel complexes can also be used.

Specific examples of organic anti-fading agents are described in the following patent specifications.

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337, and JP-A No. 152225/1987; spiroindanes are described, for example, in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. No. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079, and 4,332,886, and JP-B No. 21144/1981, respectively; hindered amines are described, for example, in U.S. Pat. Nos. 3,336,135, and 4,268,593, British Patent Nos. 1,326,889, 1,354,313, and 1,410,846, JP-B No. 1420/1976, and JP-A Nos. 114036/1983, 53846/1984, and 78344/1984; ether and ester derivatives obtained by silylating or alkylating their phenolic hydroxyl group are described, for example, in U.S. Pat. Nos. 4,155,765, 4,174,220, 4,254,216, and 4,264,720, JP-A No. 145530/1979, 6321/1980, 105147/1983, and 10539/1984, JP-B No. 37856/1982, U.S. Pat. No. 4,279,990, and JP-B No. 3263/1978; and metal complexes are described, for example, in U.S. Pat. No. 4,050,938 and 4,241,155, and British Patent No. 2,027,731 (A). These compounds are coemulsified with respective couplers, generally in amounts of 5 to 100 wt.% for respective couplers, and are added to photosensitive layers to attain the purpose. To prevent the cyan dye image from being deteriorated by heat and light, it is more effective that an ultraviolet-absorbing agent is introduced into the layers opposite to the cyan color-forming layer.

Light-fastness of the magenta color image formed from the magenta coupler and the aggregation breaking agent according to the present invention can be improved by using them together with a color image stabilizing agent represented by the following formula:

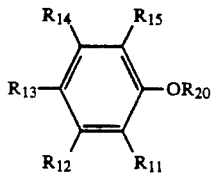

wherein $R_{20}$ represents a hydrogen atom, an alkyl group, an aryl group or a heterocyclic group; $R_{11}$, $R_{12}$, $R_{14}$ and $R_{15}$ each represents a hydrogen atom, a hydroxy group, an alkyl group, an aryl group, an alkoxy group or an acylamino group; $R_{13}$ represents an alkyl group, a hydroxy group, an aryl group or an alkoxy group; $R_{20}$ and $R_{11}$ may be combined with each other to form a 5-membered or 6-membered ring, $R_{20}$ and $R_{11}$ may be combined with each other to form a methylenedioxy ring; and $R_{13}$ and $R_{14}$ may be combined with each other to form a 5-membered hydrocarbon ring. In the substituent $R_{20}$, $R_{11}$, $R_{12}$, $R_{13}$, $R_{14}$ and $R_{15}$, an alkyl group or an alkyl moiety contains 1 to 22 carbon atoms, and an aryl group or an aryl moiety contains 6 to 22 carbon atoms. These color image stabilizing agents exhibit their anti-fading effect by acting as anti-oxidants.

Of these anti-fading agents, spiroindanes and hindered amines are particularly preferable.

In the present invention, together with the above couplers, the following compounds are preferably used. The use in combination with a pyrazoloazole coupler is, in particular, preferable.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine at the second-order reaction-specific rate $k_2$ (in trioctyl phosphate at 80° C.) in the range of 1.0 l/mol·sec to $1\times10^{-5}$ l/mol·sec. The second-order reaction-specific rate can be determined by the method described in JP-A No. 158545/1983.

If $k_2$ is over this range, the compound itself becomes unstable, and in some cases the compound reacts with gelatin or water to decompose. On the other hand, if k2 is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R_{41}-(A_2)_n-X_3 \qquad \text{Formula (FI)}$$

$$R_{42}-\underset{\underset{B_2}{|}}{C}=Y_3 \qquad \text{Formula (FII)}$$

wherein $R_{41}$ and $R_{42}$ each represent an aliphatic group, an aromatic group, or a heterocyclic group, n is 1 or 0, $A_2$ represents a group that will react with an aromatic amine developing agent to form a chemical bond therewith, $X_3$ represents a group that will react with the aromatic amine developing agent and split off, $B_2$ represents a hydrogen atom, an aliphatic group, an aromatic group, a heterocyclic group, an acyl group, or a sulfonyl group, $Y_3$ represents a group that will facilitate the addition of the aromatic amine developing agent to the compound represented by formula (II), and $R_{41}$ and $X_3$, or $Y_3$ and $R_{42}$ or $B_2$, may bond together to form a ring structure.

Of the processes wherein compound (F) bonds chemically to the remaining aromatic amine developing agent, typical processes are a substitution reaction and an addition reaction.

Preferable examples of the compounds represented by formulae (FI) and (FII) include those described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R_{51}-Z_{51} \qquad \text{Formula (GI)}$$

wherein $R_{51}$ represents an aliphatic group, an aromatic group, or a heterocyclic group, $Z_{51}$ represents a nucleophilic group or a group that will decompose in the photographic material to release a nucleophilic group. Preferably the compounds represented by formula (GI) are ones wherein $Z_{51}$ represents a group whose Pearson's nucleophilic $^{n}CH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987, 9145/1987, and 86139/1989, Japanese Patent Application No. 136724/1988, and JP-A Nos. 57259/1989 and 2042/1989.

Details of combinations of compound (G) and compound (F) are described in European Patent (Publication) No. 277,589.

The photographic material prepared in accordance with the present invention may contain, in the hydrophilic colloid layer, an ultraviolet absorber. For example, benzotriazole compounds substituted by an aryl group (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), ester compounds of cinnamic acid (e.g., those described in U.S. Pat. Nos. 3,705,805 and 3,707,375), butadiene compounds (e.g., those described in U.S. Pat. No. 4,045,229), and benzooxydole compounds(e.g., those described in U.S. Pat. No. 3,700,455) are useful. Couplers capable of absorbing ultraviolet-radiation (e.g., naphthol series cyan dye-forming couplers) and polymers capable of absorbing ultraviolet-radiation may be also used. Those ultraviolet absorbers may be mordanted in a specified layer.

The photographic material prepared in accordance with the present invention may contain, in the hydrophilic colloid layer, water-soluble dyes as filter dyes or to prevent irradiation and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin, which may be suitably selected in accordance with the purpose of the application.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 μm×6 μm, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(Ri-R)^2}{n-1}} \quad \frac{\sum_{i=1}^{n} Ri}{n}.$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

It is preferable that the present color photographic material is color-developed, bleach-fixed, and washed (or stabilized). The bleach and the fixing may not be effected in the single bath described above, but may be effected separately. If the present color photographic material is continuously processed, it is desirable that the replenishing amount of the developer is smaller, with a view to saving resources and reducing pollution.

The replenishing amount of the color developer is preferably 200 ml or below, more preferably 120 ml, and further more preferably 100 ml per square meter of the photographic material. Herein the term "replenishing amount" means the amount of the color development replenisher that is supplied, and it excludes the amounts of additives, etc., for compensating deterioration with time or condensation with time. Herein the term "additives" refers, for example, to water for diluting the condensation, preservatives that have a tendency to deteriorate with time, and alkali agents for raising the pH.

The color developer to be used in the present invention is preferably an aqueous alkali solution whose major component is an aromatic primary amine color-developing agent. As this color-developing agent, aminophenol compounds are useful, but preferably p-phenylenediamine compounds are used. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesufonamidoethylaniline, and 3-methyl-4-amino-N-ethyl-N-β-methoxyaniline, and their sulfates, hydrochlorides, and p-toluenesulfonates. Two or more of them may be combined to achieve the purpose.

The color developer generally contains, for example, pH buffers, such as carbonates, borates, or phosphates of alkali metals, development restrainers, such as bromides, iodides, benzimidazoles, benzothiazoles, or mercapto compounds, or antifoggants. If necessary the color developer contains various preservatives, such as hydroxyamine, diethylhydroxylamine, sulfites, hydrazines, phenylsemicarbazides, triethanolamine, catecholsulfonates, and triethylenediamine(1,4-diazabicyclo[2,2,2]octane), organic solvents, such as ethylene glycol and diethylene glycol, development accelerators, such as benzyl alcohol, polyethylene glycol, quaternary ammonium salts, and amines, dye forming couplers, competing couplers, fogging agents, such as sodium boron hydride, auxiliary developers, such as 1-phenyl-3-pyrazolidone, viscosity increasers, and various chelate agents, such as aminopolycarboxylic acids, aminopolyphosphonic acids, alkylphosphonic acids, and phosphonocarboxylic acids, for example ethylenediaminetetraacetic acid, nitrilotriacetic acid, diethylenetriaminepentaacetic acid, cyclohexanediaminetetraacetic acid, hydroxyethyliminodinoacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and their salts.

If a reversal process is effected, generally black-and-white development is first carried out, and then color development is carried out. In this black-and-white developing solution, use is made of a known black-and-white developing agent, such as hydroxybenzenes such as hydroquinone, 3-pyrazolidones such as 1-phenyl-3-pyrazolidone, and aminophenols such as N-methyl-p-aminophenol, which may be used alone or in combination.

Generally the pH of this color developer and black-and-white developing solution is 9 to 12. The replenishing amount of these developing solutions is generally 3 l or below per square meter of the color photographic material to be processed, though the replenishing amount changes depending on the type of color photographic material, and if the concentration of bromide ions in the replenishing solution is lowered previously, the replenishing amount can be lowered to 500 ml or below per square meter of the color photographic material. If it is intended to lower the replenishing amount, it is preferable to prevent the evaporation of the solution and oxidation of the solution with air by reducing the area of the processing tank that is in contact with the air.

It is also possible to reduce the replenishing amount by using means of suppressing the accumulation of bromide ions in the developer.

The photographic emulsion layer are generally subjected to a bleaching process after color development.

The bleaching process can be carried out together with the fixing process (bleach-fixing process), or it can be carried out separately from the fixing process. Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process.

As the bleaching agent, use can be made of, for example, compounds of polyvalent metals, such as iron (III), cobalt (III), chromium (VI), and copper (II), peracids, quinones, and nitro compounds. As typical bleaching agents, use can be made of ferricyanides; dichromates; organic complex salts of iron (II) or cobalt (III), such as complex salts of aminopolycarboxylic acids, for example ethylenediaminetetraacetic acid, diethylenetriaminetetraacetic acid, cyclohexanediaminetetraacetic acid, methyliminodiacetic acid, 1,3-diaminopropanetetraacetic acid, and glycoletherdiaminetetraacetic acid, citric acid, tartaric acid, and malic acid; persulfates; bromates; permanganates; and nitrobenzenes. Of these, aminopolycarboxylic acid iron (III) complex salts, including ethylenediaminetetraacetic acid iron (III) complex salts are particularly useful in a bleaching solution as well in a bleach-fix solution. The pH of the bleaching solution or the bleach-fix solution using these aminopolycarboxylic acid iron (III) complex salts is generally 5.5 to 8, but if it is required to quicken the process, the process can be effected at a lower pH.

In the bleaching solution, the bleach-fix solution, and the baths preceding them, a bleach-accelerating solution may be used if necessary. Examples of useful bleach-accelerating agents are compounds having a mercapto group or a disulfide linkage, described in U.S. Pat. No. 3,893,858, West German Patent Nos. 1,290,812 and 2,059,988, JP-A Nos. 32736/1987, 57831/1978, 37418/1978, 72623/1978, 95630/1978, 95631/1978, 104322/1978, 124424/1978, 141623/1978, and 28426/1978, and *Research Disclosure* No. 17129 (July, 1978); thiazolidine derivatives, described in U.S. Pat. No. 3,706,561; thiourea derivatives, described in JP-B No. 8506/1970, JP-A Nos. 20832/1977 and 32735/1978, and U.S. Pat. No. 30706,561; iodide salts, described in West German Patent No. 1,127,715 and JP-A No. 16235/1983; polyoxyethylene compounds, described in West German Patent Nos. 966,410 and 2,748,430; polyamine compounds, described in JP-B No. 836/1970; other compounds, described in JP-A Nos. 2434/1974, 59644/1978, 35727/1979, 26505/1080, and 63940/1983; and bromide ions. Of these, compounds having a mercapto group or a disulfide group are preferable in view of higher acceleration effect, and in particular, compounds described in U.S. Pat. No. 3,893,858, West German Patent No. 1,290,812, and JP-A No. 95630/1978 are preferable. Compounds described in U.S. Pat. No. 4,552,834 are preferable. These bleach-accelerating agents may be added into the photographic material. When the color photographic materials for photographing are to be bleach-fixed, these bleach-accelerating agents are particularly effective.

As a fixing agent can be mentioned thiosulfates, thiocyanates, thioether-type compounds, thioureas, and large amounts of iodide salts, although thiosulfate is used usually, and in particular ammonium thiosulfate is widely used. As the preservative for bleach-fix solution sulfite salt, bisulfite salt, or carbonyl-bisulfite adduct is preferable.

It is common for the silver halide color photographic material of the present invention to undergo, after a desilvering process such as fixing or bleach-fix, a washing step and/or a stabilizing step. The amount of washing water may be set within a wide range depending on the characteristics (e.g., due to the materials used, such as couplers), the application of the photographic material, the washing temperature, the number of washing tanks (the number of steps), the type of replenishing system, including, for example, the counter-current system and the direct flow system, and other various conditions. Of these, the relationship between the number of water-washing tanks and the amount of washing water in the multi-stage counter-current system can be found according to the method described in *Journal of Society of Motion Picture and Television Engineers,* Vol. 64, pages 248 to 253 (May, 1988).

According to the multi-stage-counter-current system described in the literature mentioned above, although the amount of washing water can be considerably reduced, bacteria propagate with an increase of retention time of the washing water in the tanks, leading to a problem with the resulting suspend matter adhering to the photographic material. In processing the present color photographic material, as a measure to solve this problem, the method of reducing calcium and magnesium described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described in Hiroshi Horiguchi "*Bokin Bobaizai no Kagaku*" in "Biseibutsu no Mekkin, Sakkin, Bobaigijutsu" edited by Eiseigijutsu-kai, and in "*Bokin Bobaizai Jiten*", edited by Nihon Bokin Bobai-Gakkai, can be used.

The pH of the washing water used in processing the present photographic material is 4 to 9, preferably 5 to 8. The washing water temperature and the washing time to be set may vary depending, for example, on the characteristics and the application of the photographic material, and they are generally selected in the range of 15° to 45° C. for 20 sec. to 10 min., and preferably in the range of 25° to 40° C. for 30 sec. to 5 min. Further, the photographic material of the present invention can be processed directly with a stabilizing solution instead of the above washing. In such a stabilizing process, any of known processes, for example, a multi-step counter-current stabilizing process or its low-replenishing-amount process, described in JP-A Nos. 8543/1982, 14834/1983, and 220345/1985.

In some cases, the above washing process is further followed by a stabilizing process, and as an example thereof can be mentioned a stabilizing bath that is used as a final bath for color photographic materials for photography, which contains formalin and a surface-active agent. In this stabilizing bath, each kind of the chelating agents and bactericides may be added.

The over-flow solution due to the replenishing of washing solution and/or stabilizing solution may be reused in other steps, such as a desilvering step.

The silver halide color photographic material of the present invention may contain therein a color-developing agent for the purpose of simplifying and quickening the process. To contain such a color-developing agent, it is preferable to use a precursor for a color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolidones. Typical compounds are described in JP-A No. 64339/1981, 144547/1982, and 115438/1983.

The various processing solutions used for the present invention are used at 10° to 50° C. Although generally a temperature of 33° to 38° C. is standard, a higher temperature can be used to accelerate the process to reduce the processing time, or a lower temperature can be used to improve the image quality or the stability of the processing solutions. Also, to save the silver of the photographic material, a process using hydrogen peroxide intensification or cobalt intensification described in West German Patent No. 2,226,770 and U.S. Pat. No. 3,674,499 may be carried out.

For fully manifestation of the excellent characteristics of the silver halide photographic material prepared in accordance with the present invention, it is preferable that the photographic material is processed by a color developer being substantially free from benzyl alcohol and containing bromide ions of 0.002 mol/l or below for 2 minutes 30 seconds or below. Herein the term "substantially free from benzyl alcohol" means that the concentration of benzyl alcohol is preferably 2 ml/l or below, and more preferably 0.5 ml/l or below, and most preferably benzyl alcohol is not contained at all.

The present silver halide color photographic material is high in light-fastness of the image dye, and thereby is remarkably improved with respect to color changes, and it exhibits an excellent effect that the color reproducibility is good.

Now, the present invention will be described in detail with reference to Examples, but the invention is not limited to them.

Reference Example 1

(1) Visible absorption spectrum of 1H-pyrazolo[1,5-b][1,2,4]triazole-azomethine dye in concentrated state Dyes A, B, C, and D having the chemical structures shown below were dissolved in trioctyl phosphate to prepare solutions having concentration of 0.2 mol/l, and the visible adsorption (at room temperature) of each of them was measured in a 0.1-mm cell by using an ultraviolet/visible spectrophotometer W-260 (manufactured by Shimazu Seisakusho Ltd.). The standardized spectra of the dyes A, B, C, and D are shown in FIG. 1.

Chemical structure of dyes A, B, C, and D:

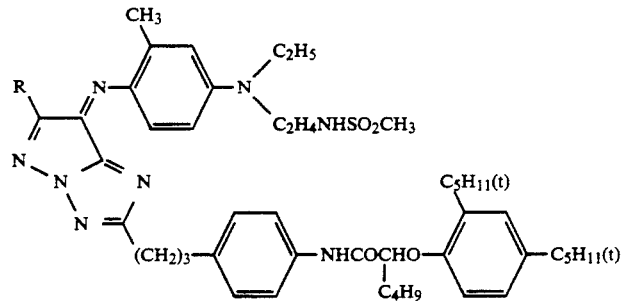

Dye A: R = $-CH_3$ Dye B: R = $-C_2H_5$ Dye C: R = $-CH(CH_3)_2$ Dye D: R = $-C(CH_3)_3$

It is evident from FIG. 1 that when a bulky alkyl substitutent was introduced in the 6-position 1H-pyrazolo[1,5,b][1,2,4]triazole dye, the lump-like absorption near 500 nm decreased. This can be construed, from the concentration dependency of the visible absorption spectrum of pyrazolotriazole dyes (the more the dye coheres, the greater the lump on the short wavelength side of the absorption spectrum is), as a result of introduction of groups which become bulky in the order of a methyl group, an ethyl group, an isopropyl group, and a t-butyl group in the 6-position, the aggregation of dyes in a concentrated state, caused breaking, reducing the lump-like absorption on the short wavelength side reduced.

(2) Light-fading test of applied samples—1

By the method described in Example 1 of JP-A No. 65,245/1986, couplers having the chemical structures shown below were applied on paper bases, both surfaces of which were laminated with polyethylene, and were developed under the same conditions thereby preparing strips.

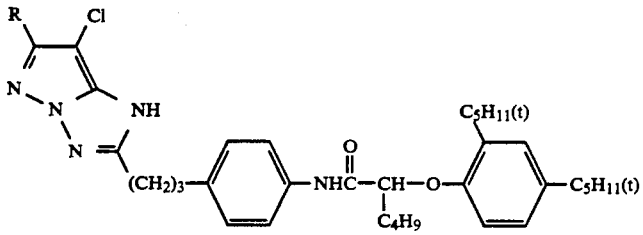

Coupler A: R = $-CH_3$ (Sample A) Coupler B: R = $-C_2H_5$ (Sample B) Coupler C: R = $-CH(CH_3)_2$ (Sample C) Coupler D: R = $-C(CH_3)_3$ (Sample D)

A UV filter for cutting UV-rays having wavelengths shorter than 390 nm is attached to the front surface of each Samples A to D, thus prepared in accordance with Example 2 of JP-A No. 65245/1986, and light irradiation was carried out using a xenon light-fading tester (100,000 Lux; intermittent exposure of one cycle of 3.8-hour exposure with 1-hour dark storage; 5 cycles a day). The fading rates (%) after 8 days of exposure for the magenta initial density $D_G$ of 1.5 are shown in Table 1.

TABLE 1

Results of the light fading test of magenta image-dyes obtained by pyrazolotriazole couplers

| | Sample A | Sample B | Sample C | Sample D |
|---|---|---|---|---|
| Fading rate (%)* | 64.5 | 61.2 | 35.8 | 30.0 |

*: after 8 days irradiation by 100,000 Lux Xe at the portion of $D_G$ of 1.5

As is apparent from the results in Table 1, as substituents higher in steric hindrance in the order of the Couplers A to B to C to D were introduced in the 6-position of 1H-pyrazolo[1,5-b][1,2,4]triazole coupler, the light-fading rates decreased, while the higher the light-fastness was, the more reduction of the lump on the main absorption spectrum was.

(3) Light-fading test of coated samples—2

10.0 g of 1H-pyrazolo[1,5,c][1,2,4]triazole coupler E shown below was added to 14.2 g of tricrecyl phosphate and 20 ml of ethyl acetate, and the mixture was heated to 60° C. to prepare a dissolved solution. The resulting mixture was added to 100 ml of an aqueous solution containing 10 g of gelatin, and 1.0 g of sodium dodecylbenzenesulfonate to prepare an emulsified dispersion by finely dispersing by mechanical means. All of this emulsified dispersion was added to 100 g of a silver chlorobromide emulsion, comprising 80 mol % of Br (that contained 6.55 g of Ag), then 10 ml of 2% sodium 2,4-dihydroxy-6-chloro-s-triazine as a hardner was added, and the resulting mixture was applied on a triacetate clear base so that the coating amount of silver might be 600 mg/m$^2$, and a gelatin layer was applied on the resulting applied layer to prepare a sample, which was designated Sample E.

Then, the same procedure was repeated, except that the Coupler E was replaced with 11.0 g of Coupler F, 19.2 g of the same high-boiling organic solvent as the above were added, and 20 ml of ethyl acetate was added, thereby preparing a sample that was designated Sample F.

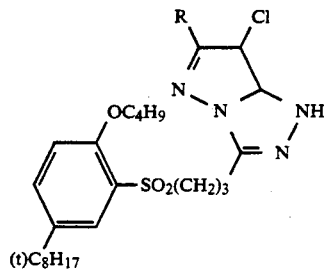

Coupler E: R = $-CH_3$

Coupler F: R = $-CH(CH_3)_2$

These Samples E and F were subjected to a wedge exposure of light of 500 CMS and to the processing process as described below.

| Step | Temperature | Time |
|---|---|---|
| 1. Color Development | 35° C. | 2 min. 30 sec. |
| 2. Bleach-fixing | 35° C. | 1 min. 30 sec. |
| 3. Water Washing | 35° C. | 3 min. |

The compositions of the respective processing solutions were as follows:

| Color developer | |
|---|---|
| Triethanolamine | 8.1 g |
| Diethylhydroxylamine | 4.2 g |
| Potassium bromide (KBr) | 0.6 g |
| Sodium sulfite | 0.13 g |
| N-Ethyl-N-(β-methanesulfonamidoethyl)-3-methyl-4-aminoaniline sulfate | 5.0 g |
| Sodium hydrogencarbonate ($NaHCO_3$) | 3.9 g |
| Potassium carbonate ($K_2CO_3$) | 18.7 g |
| Water to make | 1000 ml |

-continued

| | |
|---|---|
| pH (25° C.) | 10.05 |
| Bleach-fixing solution | |
| Water | 400 ml |
| Ammonium thiosulfate (700 g/l) | 100 ml |
| Sodium sulfite | 17 g |
| Iron (III) ammonium ethylenediamine-tetraacetate dihydrate | 55 g |
| Disodium ethylenediaminetetraacetate | 5 g |
| Ammonia bromide | 40 g |
| Water to make | 1000 ml |
| pH (25° C.) | 6.0 |

The thus-obtained color image dyes were subjected to a light-irradiation by Cannon fadometer (95,000 Lux) to test light-fastness of magenta color dye.

Results are shown in Table 2.

TABLE 2

| Sample | Initial Density ($D_G$) | After 60 hrs Exposure | After 120 hrs Exposure |
|---|---|---|---|
| E (Coupler E) | 1.5 | 0.90 | 0.18 |
| F (Coupler F) | 1.5 | 1.08 | 0.30 |

Consequently, when a bulky substituent was introduced in the 6-position of 1H-pyrazolo[5,1-c][1,2,4]triazole coupler like Coupler F, the light-fastness was higher, but in the visible absorption spectrum, the lump on the main absorption spectrum of the magenta dye obtained from the Coupler F was very small.

From the results of (1), (2), and (3) as a whole, it can be understood that when a bulky substituent was introduced in the position directly bonded to the skeleton of the above pyrazoloazole coupler, the aggregation of the azomethine dye formed from the coupler was almost disbanded, and as a result the light-fastness of the dye could be improved.

Therefore, it can be understood that the light-fastness of the azomethine dyes can also be improved by using compounds for suppressing aggregation of the azomethine dyes.

Example 1

A multilayer color photographic paper (Sample 201) having the layer-compositions described below was prepared by coating on a paper laminated on both sides with polyethylene. Coating solutions were prepared as follows:

Preparation of the first layer coating solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-3) were added and dissolved. The resulting solution was dispersed and emulsified in 185 ml of 10 % aqueous gelatin solution containing 8 ml of sodium dodecylbenzenesulfonate. Separately another emulsion was prepared by adding two kinds of blue-sensitive sensitizing dye, shown below, to a silver chlorobromide emulsion (cubic grains having 0.85 μm of grain size and 0.07 of deviation coefficient of grain size distribution, in which 1 mol % of silver bromide based on all the grains was localized at the surface of the grains) in such an amount that each sensitizing dye is $2.0\times10^{-4}$ mol per mol of silver, and then by sulfur-sensitizing. The thus-prepared emulsion was mixed with and dissolved in the above-obtained emulsified dispersion to give the composition shown below, thereby preparing the first-layer coating solution. Coating solutions for the second to seventh layers were also prepared in the same manner as the first layer coating solution. As a gelatin hardener for the respective layers, 1-hydroxy-3,5-dichloro-s-triazine sodium salt was used.

As spectral-sensitizing dyes for the respective layers, the following compounds were used:

Blue sensitive emulsion layer:

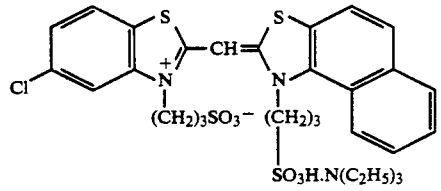

and

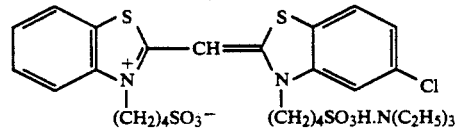

($2.0\times10^{-4}$ mol per mol of silver halide, respectively)

Green-sensitive emulsion layer:

-continued

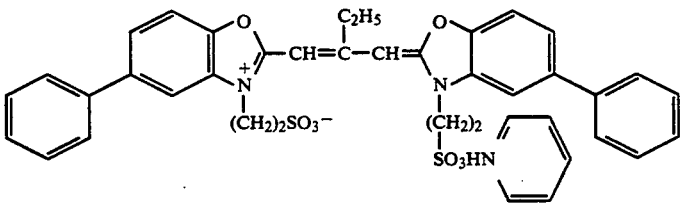

(4.0 × $10^{-4}$ mol per mol of silver halide)

and

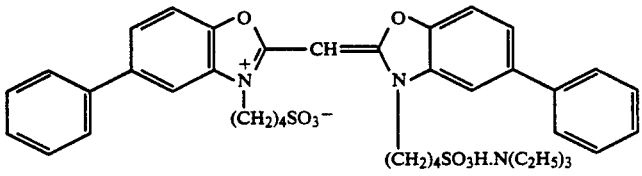

(7.0 × $10^{-4}$ mol per mol of silver halide)

Red-sensitive emulsion layer:

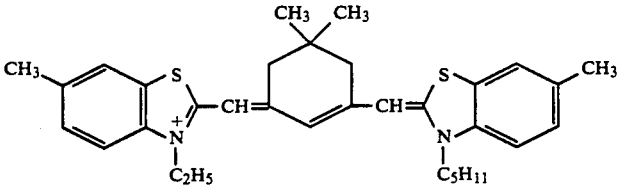

(0.9 × $10^{-4}$ mol per mol of silver halide)

To the red-sensitive emulsion layer, the following compound was added in an amount of $2.6\times10^{-3}$ mol per mol of silver halide.

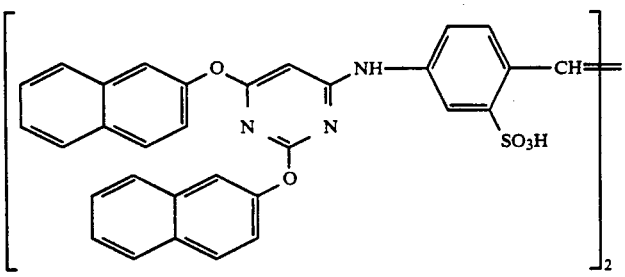

Further, 1-(5-methylureidophenyl)-5-mercaptotetrazole was added tot he blue-sensitive emulsion layer, the green-sensitive emulsion layer, and red-sensitive emulsion layer in amount of $8.5\times10^{-5}$ mol, $7.7\times10^{-4}$ mol, and $2.5\times10^{-4}$ mol per mol of silver halide, respectively.

The following dyes were added to the emulsion layers to prevent irradiation.

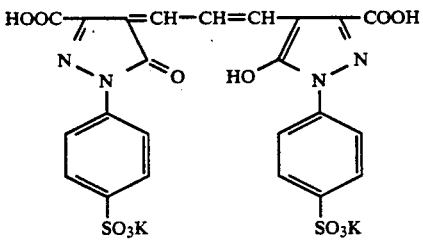

and

-continued

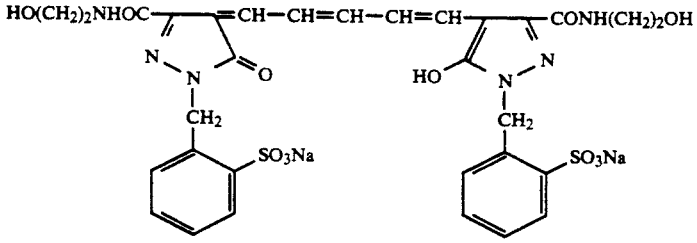

Compositions of Layers

The composition of each layer is shown below. The figures represent coating amounts (g/m$^2$). The coating amounts of each silver halide emulsion is represented in terms of silver.

Supporting base

Paper laminated on both sides with polyethylene (a white pigment, $TiO_2$, and a bluish dye, ultramarine, were included in the first layer side of the polyethylene-laminated film.)

| | |
|---|---|
| First Layer: Blue-sensitive emulsion layer | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Image-dye stabilizer (Cpd-7) | 0.03 |
| Solvent (Solv-3) | 0.35 |
| Second Layer: Color mix preventing layer | |
| Gelatin | 0.99 |
| Color mix inhibitor (Cpd-5) | 0.08 |
| Solvent (Solv-1) | 0.16 |
| Solvent (Solv-4) | 0.08 |
| Third Layer: Green-sensitive emulsion layer | |
| Silver chlorobromide emulsion (cubic grains having 0.40 μm of average grain sizes and 0.09 of deviation coefficient of grain size distribution, in which 1 mol % of silver bromide based on all the grains was localized on the grain surface) | 0.20 |
| Gelatin | 1.24 |
| Magenta coupler (ExM) | 0.30 |
| Image-dye stabilizer (Cpd-3) | 0.04 |
| Image-dye stabilizer (Cpd-4) | 0.01 |
| Image-dye stabilizer (Cpd-8) | 0.03 |
| Solvent (Solv-2) | 0.42 |
| Fourth Layer: Ultraviolet absorbing layer | |
| Gelatin | 1.58 |
| Ultraviolet absorber (UV-1) | 0.47 |
| Color mix inhibitor (Cpd-5) | 0.05 |
| Solvent (Solv-5) | 0.24 |
| Fifth Layer: Red-sensitive emulsion layer | |
| Silver chlorobromide emulsion (cubic grains having 0.36 μm of average grain sizes and 0.11 of deviation coefficient of grain size distribution, in which 1.6 mol % of silver bromide based on all the grains was localized on the grain surface) | 0.21 |
| Gelatin | 1.34 |
| Cyan coupler (ExC) | 0.34 |
| Image-dye stabilizer (Cpd-6) | 0.17 |
| Image-dye stabilizer (Cpd-7) | 0.34 |
| Image-dye stabilizer (Cpd-9) | 0.04 |
| Solvent (Solv-4) | 0.37 |
| Sixth Layer: Ultraviolet absorbing layer | |
| Gelatin | 0.53 |
| Ultraviolet abosrber (UV-1) | 0.16 |
| Color-mix inhibitor (Cpd-5) | 0.02 |
| Solvent (Solv-5) | 0.08 |
| Seventh Layer: Protective layer | |
| Gelatin | 1.33 |
| Acryl-modified copolymer of polyvinyl alcohol (Modification degree: 17%) | 0.17 |
| Liquid paraffin | 0.03 |

Compounds used are as follows:
(ExY) Yellow coupler

-continued
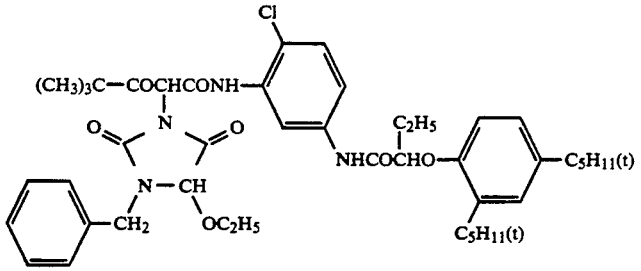
(ExM) Magenta coupler
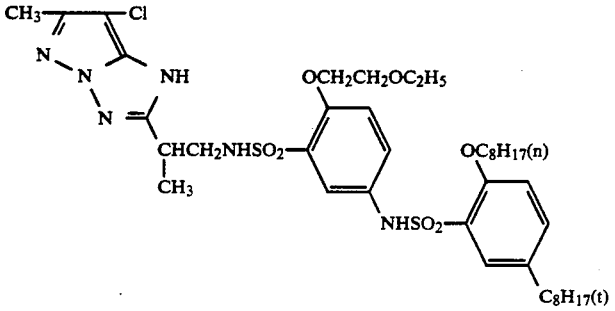
(ExC) Cyan coupler (mixture of R = H, $C_2H_5$, and $C_4H_9$ in weight ratio of 1:3:6)
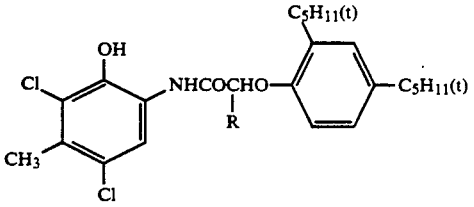
(Cpd-1) Image-dye stabilizer
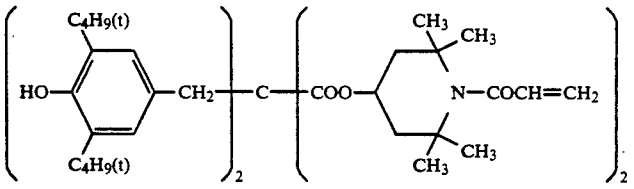
(Cpd-3) Image-dye stabilizer
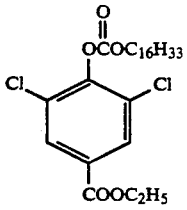
(Cpd-4) Image-dye stabilizer
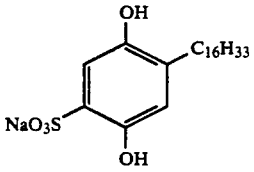
(Cpd-5) Color-mix inhibitor -continued
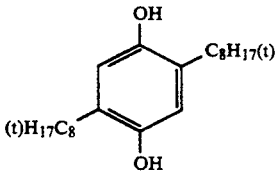
(Cpd-6) Image-dye stabilizer (mixture of 2:4:4 in weight ratio)
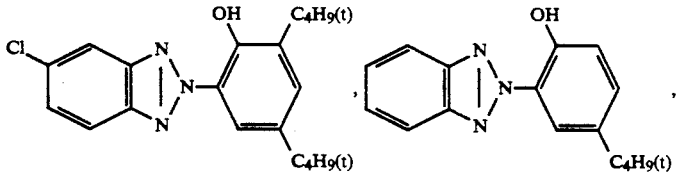
and
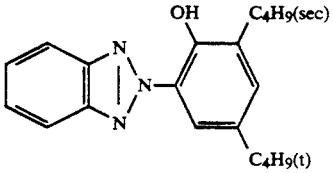
(Cpd-7) Image-dye stabilizer
$$\left(CH_2-\underset{\underset{CONHC_4H_9(t)}{|}}{CH}\right)_n$$
(average molecular weight: 60,000)
(Cpd-8) Image-dye stabilizer
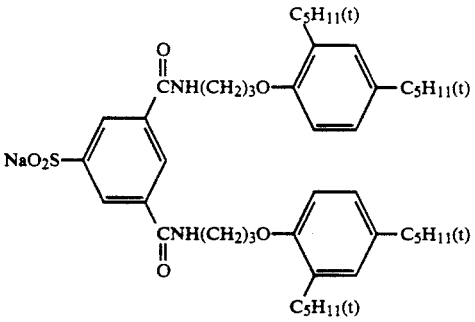
(Cpd-9) Image-dye stabilizer
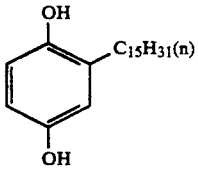
(UV-1) Ultraviolet absorber (mixture of 4:2:4 in weight ratio)
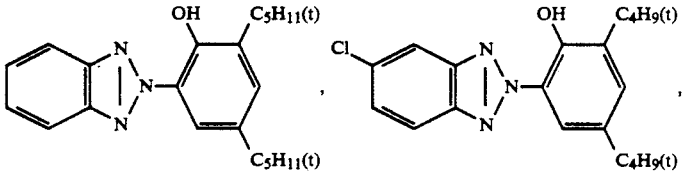
and -continued

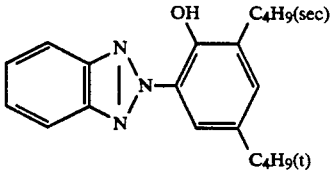

(Solv-1) Solvent

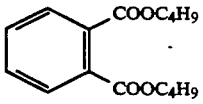

(Solv-2) Solvent (mixture of 2:1 in volume ratio)

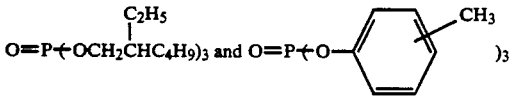

(Solv-3) Solvent
$O{=}P{\leftarrow}OC_9H_{19}(iso))_3$ (Solv-4) Solvent

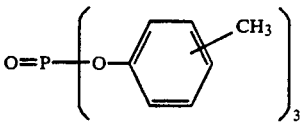

(Solv-5) Solvent
$COOCH_2CH(C_2H_5)C_4H_9$
|
$(CH_2)_8$
|
$COOCH_2CH(C_2H_5)C_4H_9$ (Solv-6) Solvent

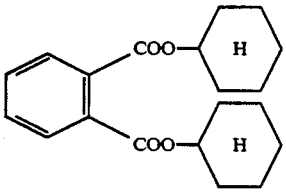

Sample 202 was prepared in the same manner as Sample 201, except that the aggregation-destroying compound (A-1) of the present invention was added in the third layer. Then, Samples 203 to 215 were prepared by adding an equimolecular amount of other aggregation-destroying compound, respectively, in place of compound of the present invention (see Table 3).

After exposure to light through an optical wedge, each sample was subjected to the processing process as described below.

| Step | Temperature | Time |
|---|---|---|
| Color Development | 35° C. | 45 sec. |
| Bleach-fixing | 35° C. | 45 sec. |
| Water Washing 1 | 35° C. | 30 sec. |
| Water Washing 2 | 35° C. | 30 sec. |
| Water Washing 3 | 35° C. | 30 sec. |
| Drying | 75° C. | 60 sec. |

The composition of the respective processing solution were as follows:

| | |
|---|---|
| Color developer | |
| Water | 800 ml |
| Ethylene-N,N,N',N'-tetramethylene phosphonic acid | 3.0 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-bis(carboxymethyl)hydrazine | 5.0 g |
| Fluorescent brightening agent (WHITEX-4, prepared by Sumitomo Chemical Industries) | 1.0 g |
| Water to make | 1000 ml |
| pH (25° C.) | 10.05 |
| Bleach-fixing solution | |
| Water | 700 ml |
| Ammonium thiosulfate (700 g/l) | 100 ml |
| Ammonium sulfite | 18 g |
| Iron (III) ammonium ethylenediamine-tetraacetate dihydrate | 55 g |
| Disodium ethylenediaminetetraacetate | 3 g |
| Ammonia bromide | 40 g |
| Glacial acetic acid | 8 g |
| Water to make | 1000 ml |
| pH (25° C.) | 5.5 |
| Water washing solution | |

-continued

| |
|---|
| Tap water treated by ion-exchange resins until each content of calcium and magnesium was 300 ppm or below (electric conductivity at 25° C. was 5 μs/cm) |

A UV filter for cutting UV light having wavelength shorter than 390 nm is attached to the front surface of each of Samples 201 to 215 thus prepared and light irradiation was carried out by a xenon light fadometer (100,000 Lux, intermittent exposure of one cycle of 3,8 hour's exposure with 1 hour's dark storage, 5 cycles per day) for 7 days. The results are shown in Table 3.

TABLE 3

| Sample No. | Additive of the Present Invention | Fading Rate after Light Irradiation (%)* |
|---|---|---|
| 201 | — | 58.4 |
| 202 | (A - 1) | 42.4 |
| 203 | (A - 14) | 41.2 |
| 204 | (B - 5) | 38.8 |
| 205 | (B - 16) | 39.2 |
| 206 | (C - 8) | 43.3 |
| 207 | (D - 1) | 44.5 |
| 208 | (D - 8) | 42.8 |
| 209 | (D - 9) | 40.2 |
| 210 | (E - 1) | 42.6 |
| 211 | (E - 8) | 39.7 |
| 212 | (E - 4) | 37.4 |
| 213 | (F - 6) | 38.3 |
| 214 | (G - 6) | 44.5 |
| 215 | (G - 12) | 40.3 |

Note;
*(initial density: 2.0)

As is apparent from the results in Table 3, it can be understood that when the compound of the present invention was added, the light-fading rate lowered and the image-dye became light-fast in comparison with not added.

Example 2

A multilayer color photographic paper (Sample 301) having layer-compositions described below was prepared by coating on a paper laminated on both sides with polyethylene. Coating solutions were prepared as follows:

Preparation of the first layer coating solution

To a mixture of 19.1 g of yellow coupler (ExY), 4.4 g of image-dye stabilizer (Cpd-1) and 1.8 g of image-dye stabilizer (Cpd-7), 27.2 ml of ethyl acetate and each 4.1 g of solvents (Solv-3) and (Solv-6) were added and dissolved. The resulting solution was dispersed and emulsified in 185 ml of 10% aqueous gelatin solution containing 8 ml of sodium dodecylbenzenesulfonate. Separately another emulsion was prepared by adding blue-sensitive sensitizing dye, shown below, to a silver chlorobromide emulsion (a mixture of cubic grains containing 80.0 mol % of silver bromide and having 0.85 μm of grain size and 0.08 of deviation coefficient, and cubic grains containing 80.0 mol % of silver bromide and having 0.62 μm of grain size and 0.07 of deviation coefficient, in Ag molar ratio of 1:3) which had been sulfur-sensitized so that the amount of sensitizing dye might be $5.0\times10^{-4}$ mol per mol of silver. The thus-prepared emulsion was mixed with and dissolved in the above-obtained emulsified dispersion to give the composition shown below, thereby preparing the first layer coating solution. Coating solutions for the second to seventh layers were also prepared in the same manner as in the first layer coating solution. As a gelatin hardener for the respective layers, 1-hydroxy-3,5-dichloro-s-traizine sodium salt was used.

As spectral-sensitizing dyes for the respective layers, the following compounds were used:

Blue-sensitive emulsion layer:

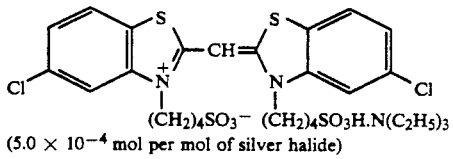

($5.0\times10^{-4}$ mol per mol of silver halide)

Green-sensitive emulsion layer:

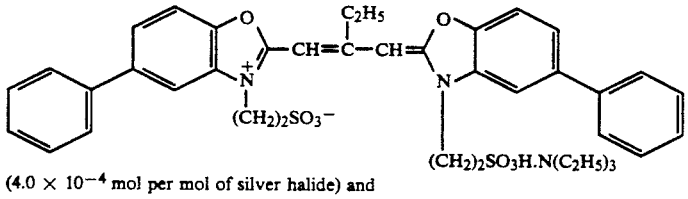

($4.0\times10^{-4}$ mol per mol of silver halide) and

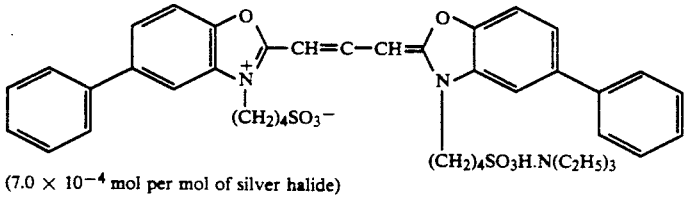

($7.0\times10^{-4}$ mol per mol of silver halide)

Red-sensitive emulsion Layer:
The same as in Example 1

To the red-sensitive emulsion layer, the same compound as in Example 1 was added in an amount of $2.6\times10^{-3}$ mol per mol of silver halide.

Further, to the blue-sensitive emulsion layer, the green-sensitive layer, and the red-sensitive layer, 1-(5-methylureidophenyl)-5-mercapto-tetrazole was added in amounts of $4.0\times10^{-6}$ mol, $3.0\times10^{-5}$ mol, and $1.0\times10^{-5}$ mol per mol of silver halide, respectively, and 2-methyl-5-t-octylhydroquinone was added in amounts of $8\times10^{-3}$ mol, $2\times10^{-3}$ mol, and $2\times10^{-2}$ mol per mol of silver halide, respectively.

Further, to the blue-sensitive emulsion layer and the green-sensitive layer 4-hydroxy-6-methyl-1,3,3 -3a,7-tetrazaindene was added in amounts of $1.2\times10^{-2}$ mol and $1.1\times10^{-2}$ mol per mol of silver halide, respectively.

The same dyes as in Example 1 were added to the emulsion layers to prevent irradiation.

Compositions of Layers:

The composition of each layer is shown below. The figures represent coating amounts (g/m$^2$). The coating amounts of each silver halide emulsion is represented in terms of silver.

Base

Paper laminated on both sides with polyethylene (a white pigment, $TiO_2$, and a bluish dye, ultramarine, were included in the first layer side of the polyethylene-film laminated.)

| | |
|---|---|
| First Layer: Blue-sensitive emulsion layer | |
| The above-described silver chlorobromide emulsion (AgBr: 80 mol %) | 0.26 |
| Gelatin | 1.83 |
| Image-dye stabilizer (Cpd-1) | 0.83 |
| Image-dye stabilizer (Cpd-7) | 0.19 |
| Solvent (Solv-3) | 0.18 |
| Solvent (Solv-6) | 0.18 |
| Second Layer: Color mix preventing layer | |
| Gelatin | 0.99 |
| Color mix inhibitor (Cpd-5) | 0.08 |
| Solvent (Solv-1) | 0.16 |
| Solvent (Solv-4) | 0.08 |
| Third Layer: Green-sensitive emulsion layer | |
| Silver chlorobromide emulsion (a mixture of cubic grains containing 90 mol % of silver bromide and having 0.47 μm of grain size and 0.09 of deviation coefficient, and cubic grains containing 90 mol % of silver bromide and having 0.46 μm of grain size and 0.09 of deviation coefficient, in Ag mol ratio of 1:1) | 0.16 |
| Gelatin | 1.79 |
| Magenta coupler (M-13) | 0.30 |
| Image-dye stabilizer (Cpd-3) | 0.20 |
| Image-dye stabilizer (Cpd-8) | 0.03 |
| Image-dye stabilizer (Cpd-4) | 0.01 |
| Image-dye stabilizer (Cpd-9) | 0.04 |
| Solvent (Solv-2) | 0.65 |
| Fourth Layer : Ultraviolet absorbing layer | |
| Gelatin | 1.58 |
| Ultraviolet absorber (UV-1) | 0.47 |
| Color mix inhibitor (Cpd-5) | 0.05 |
| Solvent (Solv-5) | 0.24 |
| Fifth Layer: Red-sensitive emulsion layer | |
| Silver chlorobromide emulsion (a mixture of cubic grains containing 70 mol % of silver bromide and having 0.49 μm of grain size and 0.08 of deviation coefficient, and cubic grains containing 70 mol % of silver bromide and having 0.34 μm of grain size and 0.10 of deviation coefficient, in Ag mol ratio of 1:2) | 0.23 |
| Gelatin | 0.34 |

-continued

| | |
|---|---|
| Cyan coupler (ExC) | 0.30 |
| Image-dye stabilizer (Cpd-6) | 0.17 |
| Image-dye stabilizer (Cpd-7) | 0.40 |
| Solvent (Solv-6) | 0.20 |
| Sixth Layer: Ultraviolet absorbing layer | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh Layer: Protective layer | |
| Gelatin | 1.33 |
| Acryl-modified copolymer of polyvinyl alcohol (Modification degree: 17%) | 0.17 |
| Liquid paraffin | 0.03 |

Compounds used are as follows:

(Cpd-1) Image-dye stabilizer
The same as Example 1

(Cpd-3) Image-dye stabilizer

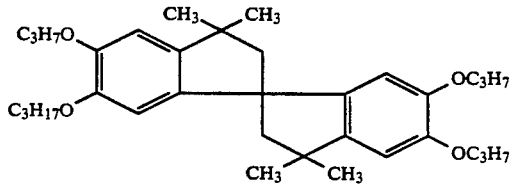

(Cpd-4) Image-dye stabilizer
The same as in Example 1

(Cpd-5) Color-mix inhibitor
The same as in Example 1

(Cpd-6) Image-dye stabilizer
The same as in Example 1

(Cpd-7) Image-dye stabilizer
The same as in Example 1

(Cpd-8) Image-dye stabilizer
The same as in Example 1

(Cpd-9) Image-dye stabilizer

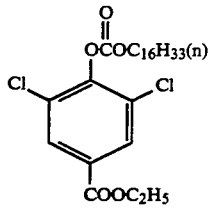

(UV-1) Ultraviolet absorber
The same as in Example 1

(Solv-1) Solvent
The same as in Example 1

(Solv-2) Solvent (mixture of 2:1 in volume ratio)

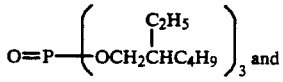

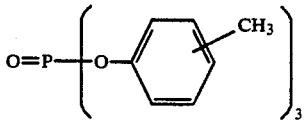

(Solv-3) Solvent

The same as in Example 1

(Solv-4) Solvent

The same as in Example 1

(Solv-5]Solvent

The same as in Example 1

(Solv-6) Solvent

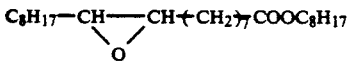

(ExY) Yellow coupler

The same as in Example 1

(ExC) Cyan coupler (mixture of 1:1 in mol ratio)

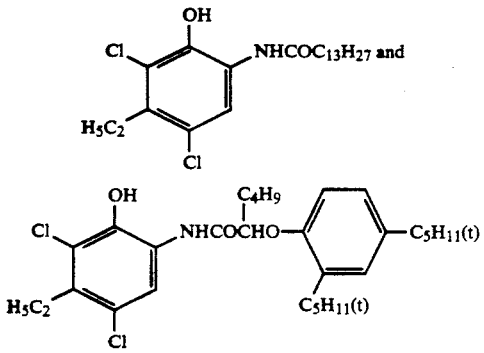

Sample 302 was prepared by the same manner as Sample 301, except that the aggregation-destroying compound (A-2) of the present invention was further added in the third layer in an amount of 0.14 g/m$^2$. Then, Samples 303 to 314 were prepared by adding an equimolecular amount of other aggregation-destroying compound, respectively, in place of compound (A-2) of the present invention (see Table 3).

After exposure to light through an optical wedge, each sample was subjected to the processing process as described below.

| Processing Step | Temperature | Time |
|---|---|---|
| Color Development | 37° C. | 3 min. 30 sec. |
| Bleach-fixing | 33° C. | 1 min. 30 sec. |
| Water-fixing | 24–34° C. | 3 min. |
| Drying | 70–80° C. | 1 min. |

The composition of the respective processing solution were as follows:

| | |
|---|---|
| Color developer | |
| Water | 800 ml |
| Ethylenetriaminepentaacetic acid | 1.0 g |
| Nitrilotriacetic acid | 2.0 g |
| 1-hydroxyethylidene-1,1-diphosphonic acid (60% solution) | 1.0 ml |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-Ethyl-N-(β-methanesulfonamidoethyl)-3-methyl-4-aminoaniline sulfate | 4.5 g |
| Fluorescent brightening agent (WHITEX-4, made by Sumitomo Chemical Industries) | 1.0 g |
| Water to make | 1000 ml |

-continued

| | |
|---|---|
| pH (25° C.) | 10.25 |
| Bleach-fixing solution | |
| Water | 400 ml |
| Ammonium thiosulfate (70%) | 150 ml |
| Sodium sulfite | 18 g |
| Iron (III) ammonium ethylenediamine-tetraacetate dihydrate | 55 g |
| Disodium ethylenediaminetetraacetate | 5 g |
| Water to make | 1000 ml |
| pH (25° C.) | 6.70 |

The thus-obtained color image dye of each sample was subjected to a light-irradiation by xenon fadometer (200,000 Lux) for 7 days. The change of density at an initial density of 1.5 before test was determined by the measurement using Fuji automatic densitometer (made by Fuji Photo Film Co., Ltd.). Results are shown in Table 4. In the results the larger value designates the higher light-fastness of an image-dye.

TABLE 4

| Sample No. | Additive of the Present Invention | Fading Rate after Light Irradiation (%)* |
|---|---|---|
| 301 | — | 79.5 |
| 302 | (A - 2) | 83.6 |
| 303 | (A - 5) | 82.4 |
| 304 | (B - 3) | 81.4 |
| 305 | (B - 9) | 83.8 |
| 306 | (C - 8) | 81.7 |
| 307 | (D - 10) | 83.4 |
| 308 | (E - 6) | 83.7 |
| 309 | (E - 11) | 84.1 |
| 310 | (F - 12) | 82.6 |
| 311 | (F - 16) | 81.9 |
| 312 | (G - 4) | 84.2 |
| 313 | (H - 3) | 82.2 |
| 314 | (H - 20) | 83.4 |

Note;
*Xenon, 7 days, $D_0$ = 1.5

As is apparent from results in Table 4, each sample of Samples 302 to 314 including an additive of the present invention was excellent in light-fastness.

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide color photographic material having at least one silver halide emulsion layer on a base, wherein said emulsion layer comprises at least one magenta coupler in the green-sensitive emulsion layer represented by the following formula (I):

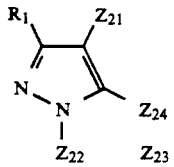

Formula (I)

wherein $R_1$ represents a hydrogen atom or a substituent, $Z_{21}$ represents a hydrogen atom, or a group capable of being released upon a coupling reaction with the oxidized product of an aromatic primary amine color developing agent, $Z_{22}$, $Z_{23}$, and $Z_{24}$ each represent

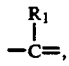

—N=, or —NH—, one of the $Z_{24}$—$Z_{23}$ bond and the $Z_{23}$—$Z_{22}$ bond is a double bond and the other is a single bond, and when the $Z_{23}$—$Z_{22}$ bond is a carbon-carbon double bond it may be part of the aromatic ring, and at least one compound in the green-sensitive emulsion layer that can break the aggregation of an azomethine dye formed from said magenta coupler and the oxidized product of the color developing agent, said compound being selected from the group consisting of:

(A) acetylene alcohols, (B) large hetero-ring compounds and large carbon-ring compounds, (C) cyclodextrin inclusion compounds, (D) amphipatic compounds that form Langmuir-Blodgett films, (E) BINAP-series compounds, (F) hydrogen breaking agents having the following formula:

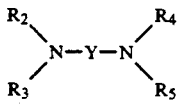

wherein $R_2$ and $R_4$ each represent a hydrogen atom and $R_3$ and $R_5$ each represent a hydrogen atom or an alkyl group, $R_2$, $R_3$, $R_4$ and $R_5$ do not represent hydrogen atoms respectively at the same time, $R_3$ and $R_5$ may together form a ring, when $R_3$ and $R_5$ together form a ring, $R_2$ and $R_4$ each represent a hydrogen atom or an alkyl group but at least one of $R_2$ and $R_4$ represents a hydrogen atom, and Y represents a carbonyl group or a sulfonyl group, or the hydrogen breaking agents are selected from the group consisting of (F-1)–(F-9), F-13), and (F-14):

(F-1)

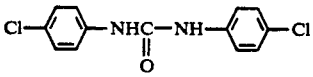

(F-2)

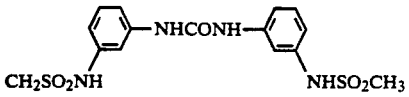

(F-3)

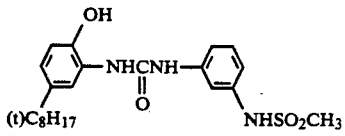

(F-4)

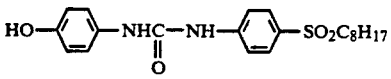

(F-5)

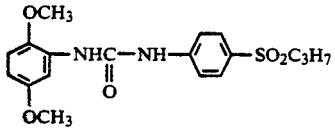

-continued (F-6)

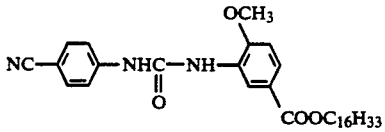

(F-7)

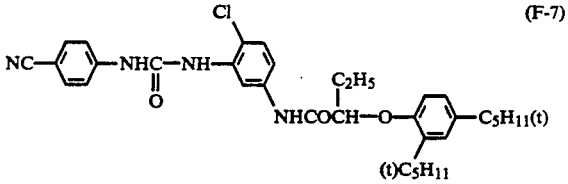

(F-8)

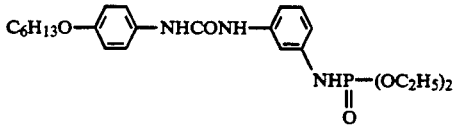

(F-9)

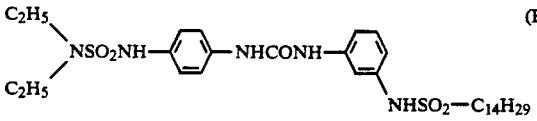

(F-13)

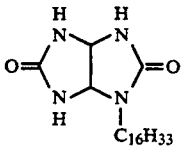

(F-14)

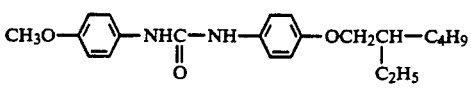

(G) a compound that can break aggregation of photographic sensitizing dyes having a skeleton represented by formulas (V) or (VII):

$$A_1\text{-}(L)_n\text{-}B_1 \qquad \text{Formula (V)}$$

wherein $A_1$, and $B_1$, which may be the same or different, each is selected from the group consisting of a furyl group, a thienyl group, a pyrrolyl group, a triazinyl group, a triazolyl group, an imidazolyl group, a pyridyl group, a pyrimidyl group, a pyrazinyl group, a quinazolinyl group/ a purinyl group, a qunolinyl group, an acridinyl group, an indolyl group, a thiazolyl group, an oxazolyl group, and a furazanyl group, L is selected from the group consisting of a methylene group, an ethylene group, a phenylene group, a propylene group, a 1-oxo-2-butenyl-1,3-ene group, a p-xylene-α,α'-diyl group, an ethylenedioxy group, a succinyl group, and a malonyl group, and n is 0 or 1 and the total number of carbon atoms of $A_1$, $B_1$, and L is 15 or over,

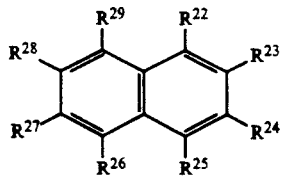

Formula (VII)

wherein $R^{22}$, $R^{23}$, $R^{24}$, $R^{25}$, $R^{26}$, $R^{27}$, $R^{28}$, and $R^{29}$, which may be the same or different, each represent a hydrogen atom, a halogen atom, a hydroxyl group, a substituted or unsubstituted alkyl group, a substituted or unsubstituted aryl group, a substituted or unsubstituted alkoxy group, a substituted or unsubstituted amino group, a mercapto group, a cyano group, a carboxyl group, a substituted or unsubstituted aryloxy group, a substituted or unsubstituted alkylthio group, a substituted or unsubstituted arylthio group, a substituted or unsubstituted acylamino group, a substituted or unsubstituted sulfonamido group, a substituted or unsubstituted acyl group, a substituted or unsubstituted sulfamoyl group, a substituted or unsubstituted carbamoyl group, a substituted or unsubstituted alkoxycarbonyl group, or a substituted or unsubstituted aryloxycarbonyl group, and the total number of carbon atoms of $R^{22}$ through $R^{29}$ is 10 or over, with the exception that $R^{21}$, $R^{25}$, $R^{26}$, or $R^{29}$ is not a hydroxyl group.

2. The silver halide color photographic material as claimed in claim 1, wherein the magenta coupler represented by formula (I) is represented by the following formula (II) or (III):

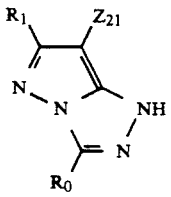

Formula (II)

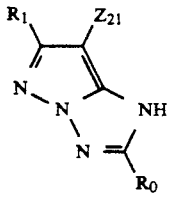

Formula (III)

wherein $R_1$ and $R_0$, which may be the same or different represent a hydrogen atom or a substituent, respectively, provided that when $R_1$ is a hydrogen atom, a halogen atom, or a cyano group, $R_0$ is not a hydrogen atom, a halogen atom, or a cyano group.

3. The silver halide color photographic material as claimed in claim 1, wherein the magenta coupler represented by formula (I) is added in a range of 0.001 to 1 mol per mol of silver halide.

4. The silver halide color photographic material as claimed in claim 1, wherein the large hetero-ring compound and large carbon-ring compound is selected from crown ethers.

5. The silver halide color photographic material as claimed in claim 1, wherein the compound that can break the aggregation of the azomethine dye is used in the range of 5 to 300 mol % for the magenta coupler.

6. The silver halide color photographic material as claimed in claim 1, wherein the magenta coupler represented by formula (I) and the compound that can break the aggregation of the azomethine dye are dispersed in at least one high-boiling organic solvent and contained in a silver halide emulsion layer.

7. The silver halide color photographic material as claimed in claim 1, wherein (A) the acetylene-alcohols are selected from the group consisting of (A-1)–(A-12) and (A-15)

(A-1)

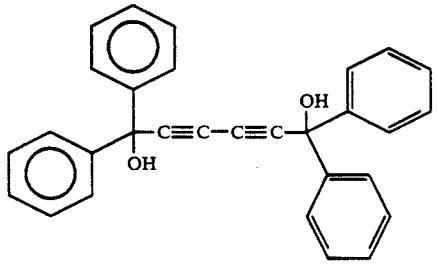

(A-2)

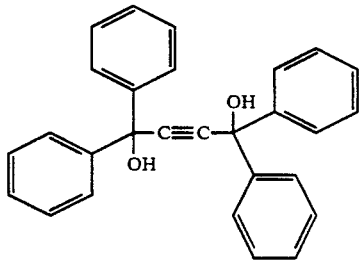

(A-3)

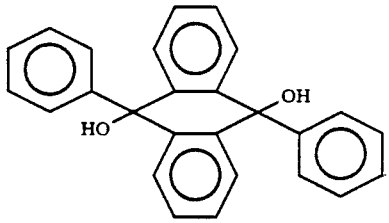

(A-4)

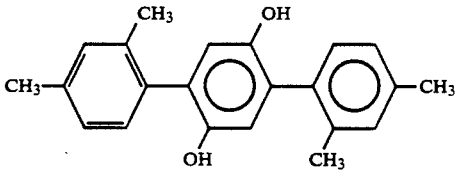

(A-5)

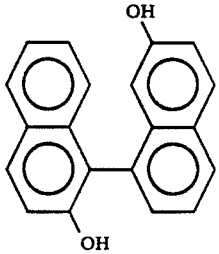

-continued
(A-6)
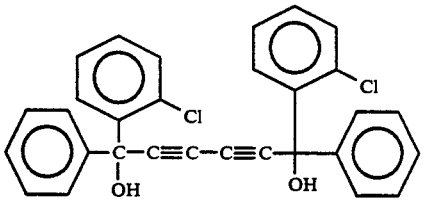
(A-7)
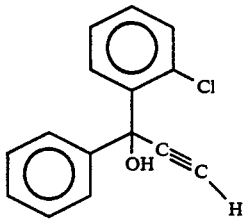
(A-8)
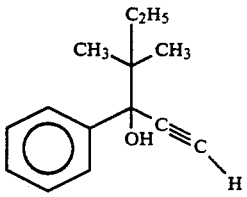
(A-9)
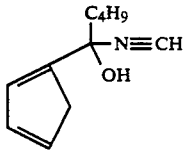
(A-10)
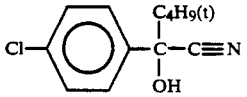
(A-11)
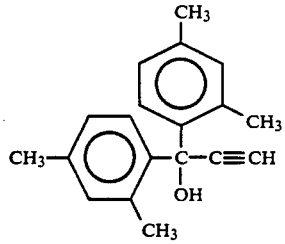
(A-12)
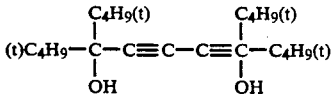
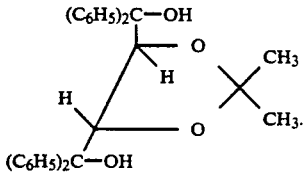
8. The silver halide color photographic material as claimed in claim 1, wherein (B) the large hetero-ring compounds and large carbon-ring compounds are selected from the group consisting of (B-1)–(B-16)
(B-1)
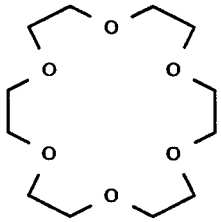
(B-2)
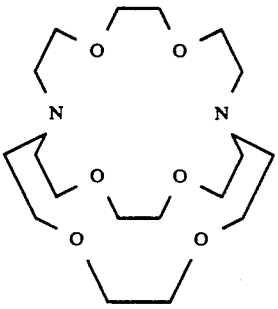
(B-3)
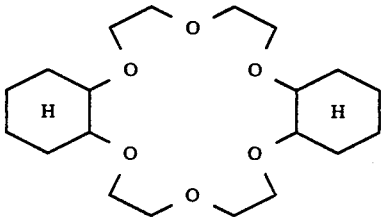
(B-4)
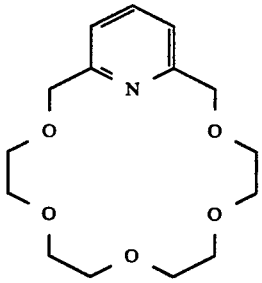
(B-5)
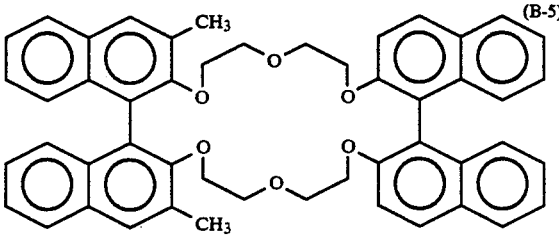

-continued
(B-6)
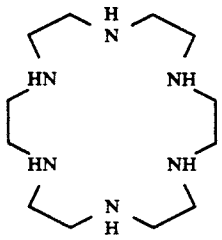
(B-7)
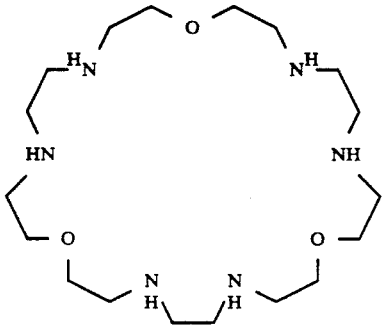
(B-8)
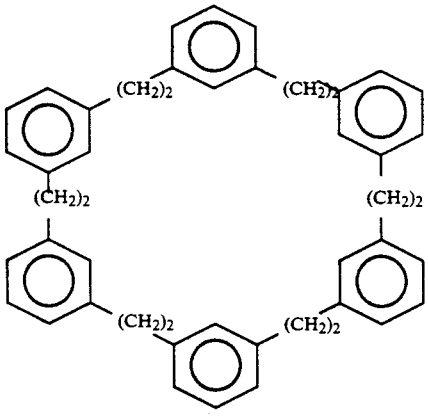
(B-9)
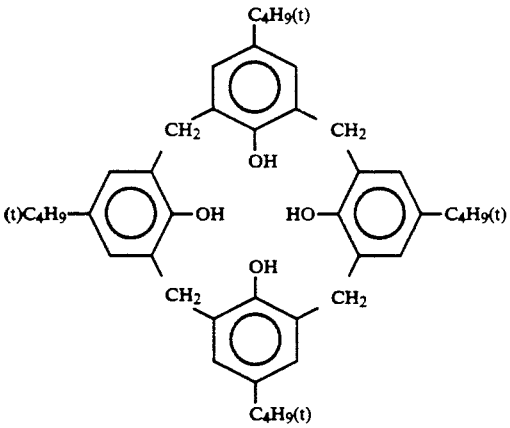
-continued
(B-10)
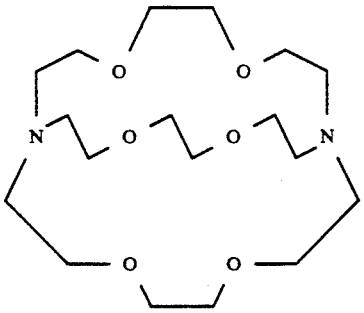
(B-11)
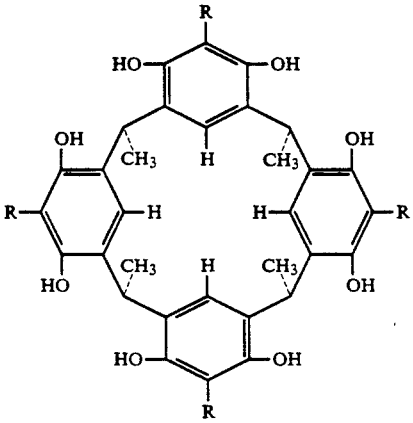
(B-12)
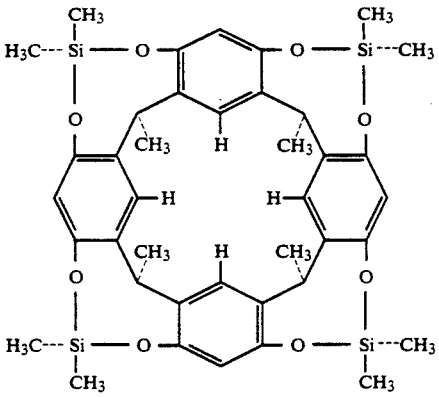
(B-13)
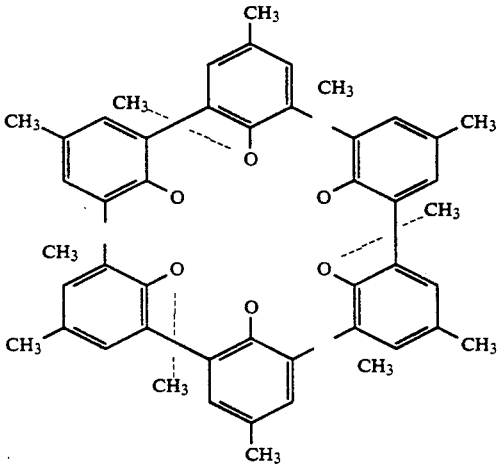

-continued
(B-14)
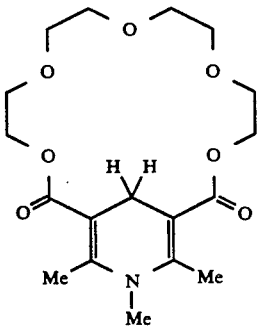
(B-15)
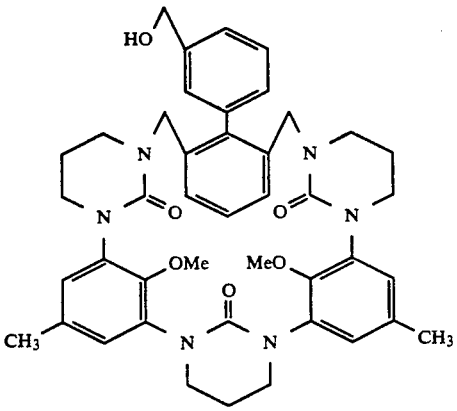
(B-16)
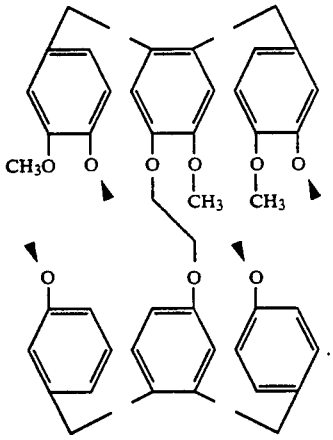
9. The silver halide color photographic material as claimed in claim 1, wherein (C) the cyclodextrin inclusion compounds are selected from the group consisting of (C-1)-(C-8)
(C-1)
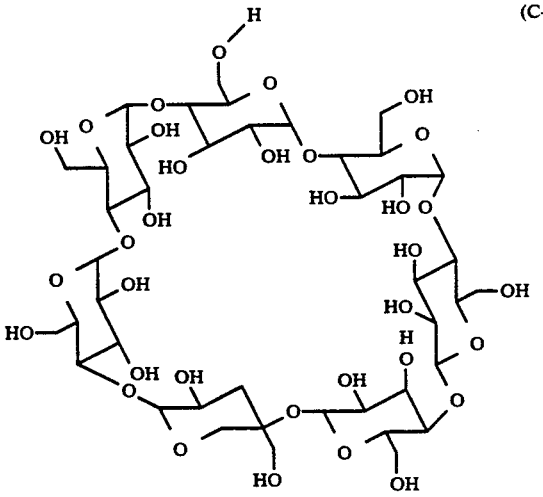
β-Cyclodextrin
(hereinafter abbreviated as )
(C-2)
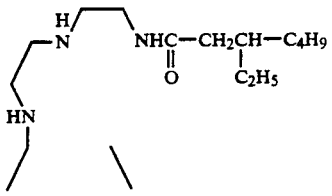
(C-3)
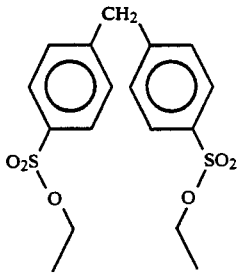
(C-4)
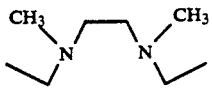
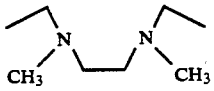
(C-5)
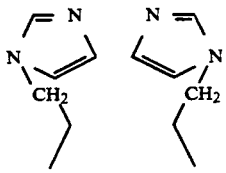

-continued
(C-6)
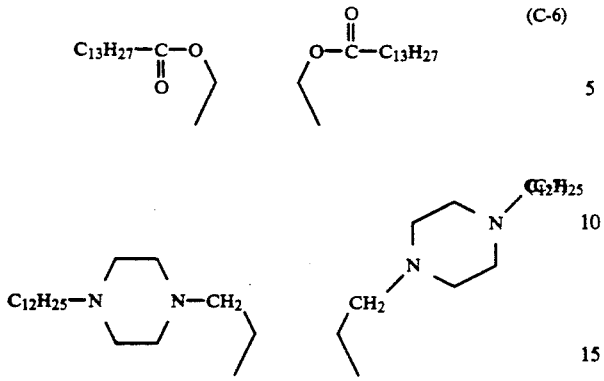
-continued
(C-8)
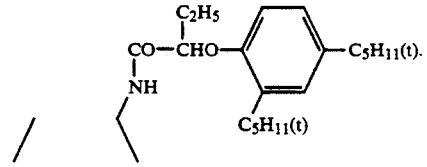
10. The silver halide color photographic material as claimed in claim 1, wherein (D) the amphipatic compounds that form Langmuir-Blodgett films are selected from the group consisting of (D-1)–(D-13)
(D-1)
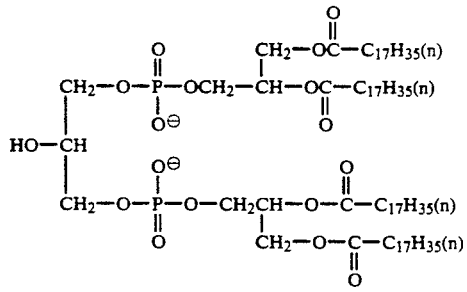
(D-2)
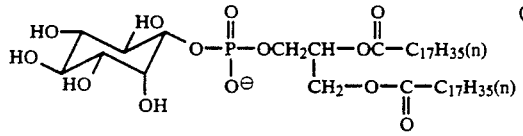
(D-3)
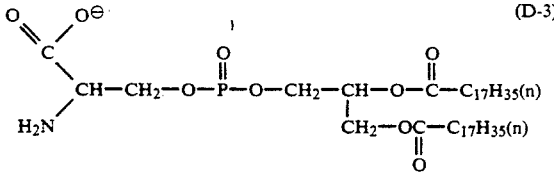
(D-4)
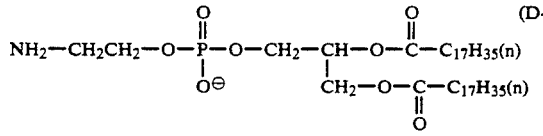
(D-5)
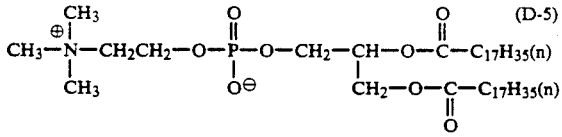
(D-6)
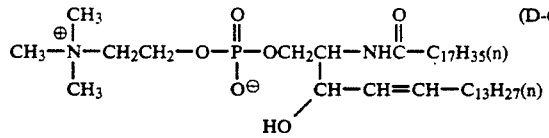
(D-7)
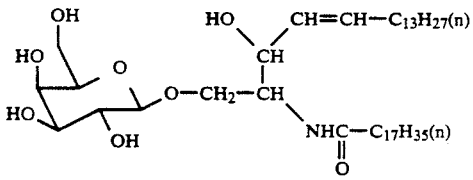
(D-8)
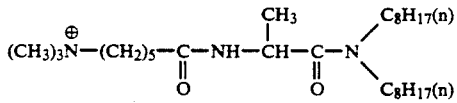
(D-9)
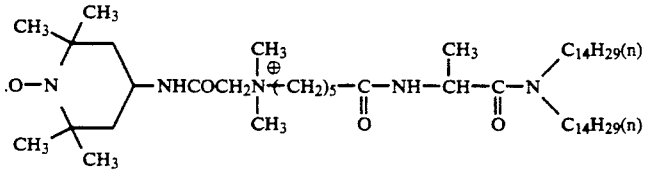

-continued
(D-10)
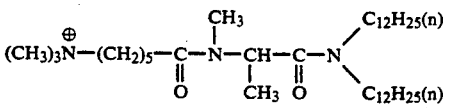
(D-11)
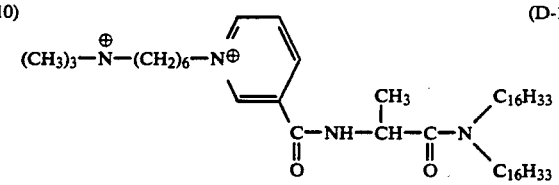
(D-12)
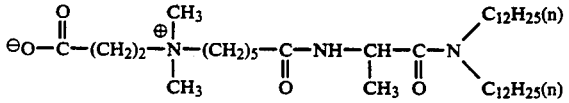
(D-13)
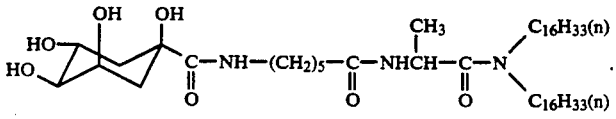
-continued
(E-11)
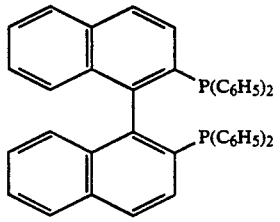
(R)-BINAP
(E-12)
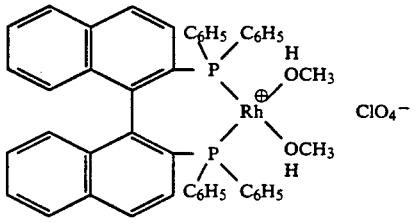
(E-13)
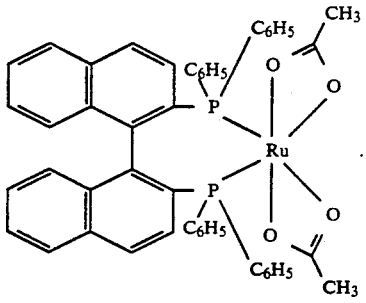
11. The silver halide color photographic material as claimed in claim 1, wherein (E) the BINAP series compounds are selected from the group consisting of (E-8)-(E-13)
8n 2097
(E-8)
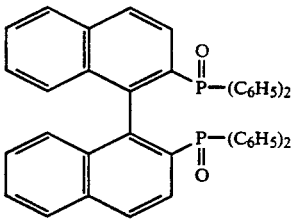
(E-10)
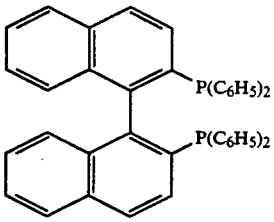
(S)-BINAP
12. The silver halide color photographic material as claimed in claim 1, wherein in formula (V), n is 0.
* * * * *